US007489325B2

(12) United States Patent
Amano

(10) Patent No.: US 7,489,325 B2
(45) Date of Patent: Feb. 10, 2009

(54) DISPLAY DEVICE

(75) Inventor: Ryuhei Amano, Hirakata (JP)

(73) Assignee: Sanyo Electric Co., Ltd., Osaka (JP)

( * ) Notice: Subject to any disclaimer, the term of this patent is extended or adjusted under 35 U.S.C. 154(b) by 505 days.

(21) Appl. No.: 11/083,092

(22) Filed: Mar. 18, 2005

(65) Prior Publication Data

US 2005/0206592 A1 Sep. 22, 2005

(30) Foreign Application Priority Data

Mar. 18, 2004 (JP) ..... 2004-077837
Feb. 28, 2005 (JP) ..... 2005-052439

(51) Int. Cl.
*G09G 5/10* (2006.01)

(52) U.S. Cl. ..... 345/690; 345/77

(58) Field of Classification Search ..... 345/55, 345/76, 77, 84, 690; 315/169.3; 313/463
See application file for complete search history.

(56) References Cited

U.S. PATENT DOCUMENTS

| | | | | |
|---|---|---|---|---|
| 6,265,833 | B1 | 7/2001 | Kim et al. | |
| 6,492,970 | B1 | 12/2002 | Furuhashi et al. | |
| 7,227,520 | B2 * | 6/2007 | Watanabe et al. | 345/77 |
| 2003/0107682 | A1 * | 6/2003 | Sono | 348/687 |
| 2003/0122813 | A1 | 7/2003 | Ishizuki et al. | |
| 2003/0169220 | A1 | 9/2003 | Tsuchiya et al. | |
| 2004/0252083 | A1 * | 12/2004 | Watanabe et al. | 345/74.1 |
| 2005/0041047 | A1 * | 2/2005 | Miyata et al. | 345/690 |
| 2005/0206634 | A1 | 9/2005 | Hamanmoto et al. | |

FOREIGN PATENT DOCUMENTS

| | | |
|---|---|---|
| CN | 1256478 A | 6/2000 |
| JP | 03-231287 | 10/1991 |
| JP | 11-015445 | 1/1999 |
| JP | 11-051445 | 1/1999 |

(Continued)

OTHER PUBLICATIONS

Chinese Office Action issued in corresponding Chinese Patent Application No. CN 2005100558979, mailed on Nov. 30, 2007.
Japanese Office Action issued in Japanese Patent Application No. JP 2005-052439 dated on Apr. 22, 2008.

*Primary Examiner*—Amr Awad
*Assistant Examiner*—Dennis P Joseph
(74) *Attorney, Agent, or Firm*—McDermott Will & Emery LLP

(57) ABSTRACT

A display device includes a self light-emitting display in which data electrodes and scanning electrodes are arranged in matrix form, and a modulating voltage is applied to the data electrode side while a threshold voltage is applied to the scanning electrode side, the device including: a signal level range determination means for digitally processing an input signal to determine a signal level range of the input signal for every prescribed frame number unit; a threshold voltage control means for controlling a threshold voltage based upon a determination result by the signal level range determination means; and an input signal correction means for correcting an input signal level based upon a determination result by the signal level range determination means.

9 Claims, 19 Drawing Sheets

FOREIGN PATENT DOCUMENTS

| | | |
|---|---|---|
| JP | 2000-250491 | 9/2000 |
| JP | 2002-182612 | 6/2002 |
| JP | 2003-263128 | 9/2003 |
| JP | 2003-337580 | 11/2003 |
| JP | 2005-301229 | 10/2005 |
| WO | WO 2004/001715 A1 | 12/2003 |

* cited by examiner

DISPLAY DEVICE

BACKGROUND OF THE INVENTION

1. Field of the Invention

The present invention relates to a display device comprising a self light-emitting display.

2. Description of the Related Art

As shown in FIG. 1, a self light-emitting display 10 is known in which data electrodes and scanning electrodes are arranged in matrix form, and a modulating voltage is applied by a data driver 11 to the data electrode side while a threshold voltage is applied by an operation driver 12 to the scanning electrode side. The display 10 as thus configured is called a passive display.

FIG. 2 shows a light-emitting characteristic of a self light-emitting element for use in the self light-emitting display.

As shown in FIG. 2, the self light-emitting element starts emitting light upon application of a voltage not lower than a light-emission starting voltage "Vstart". The light-emitting luminance increases as the voltage applied to the self light-emitting element becomes higher.

In a display device comprising the above-mentioned self light-emitting display, for example, a threshold voltage "Vth" corresponding to the light-emission starting voltage "Vstart" is sequentially applied to each scanning electrode of the self light-emitting display, as shown in FIG. 3. A modulating voltage "Vmod" of 0 to $Vmod_{max}$, according to the signal level, is applied to the data electrodes of the self light-emitting display. As a result, a voltage of "Vth+Vmod ($0 \leqq Vmod \leqq Vmod_{max}$)" is applied to a light-emitting element which is an intersection of the scanning electrode and the data electrode, and light is emitted at a luminance based upon the applied voltage.

In such a conventional display device (first conventional example), there is a problem in that "$Vmod_{max}$" cannot be set sufficiently large due to performance of the data driver 11 and thereby high luminance cannot be obtained.

For obtaining high luminance, a display device (second conventional example) has already been developed in which "Vth" is set higher than the light-emission starting voltage "Vstart", as shown in FIG. 4. In the second conventional example, however, there is a problem in that the light-emitting element emits light in some quantity even with the signal level set to 0 (the modulating voltage "Vmod" set to 0), thereby leading to degradation in contrast.

SUMMARY OF THE INVENTION

It is an object of the present invention to provide a display device capable of promoting high luminance with respect to an image whose signal level is totally high, without degrading contrast.

It is also an object of the present invention to provide a display device which is capable of high luminance display with respect to an image whose signal level is totally high, and is capable of reduction in black level with respect to an image whose signal level is totally low, thereby allowing promotion of improvement in contrast and an increase in luminance.

A first display device according to the present invention comprises a self light-emitting display, in which data electrodes and scanning electrodes are arranged in matrix form, and a modulating voltage is applied to the data electrode side while a threshold voltage is applied to the scanning electrode side, the device comprising: a signal level range determination means for digitally processing an input signal to determine a signal level range of the input signal for every prescribed frame number unit; a threshold voltage control means for controlling a threshold voltage based upon a determination result by the signal level range determination means; and an input signal correction means for correcting an input signal level based upon a determination result by the level range detection means.

As the threshold voltage control means, for example, a means is used by which a threshold voltage is set low when the signal level range determined by the signal level range determination means is the entire level range except for a high luminance part, whereas the threshold voltage is set high when the signal level range determined by the signal level range determination means is the entire level range except for a low luminance part.

As the input signal correction means, for example, a means is used by which an input signal is corrected such that the signal level range is extended to the high luminance side when the signal level range determined by the signal level range determination means is the entire level range except for a high luminance part, whereas an input signal is corrected such that the signal level range is extended to the low luminance side when the signal level range determined by the signal level range determination means is the entire level range except for a low luminance part.

The display device may comprise a scene change detection means, and the signal level range determination means may update the determination result of the signal level range of the input signal only when a scene change is detected by the scene change detection means.

A second display device according to the present invention comprises an active display, the device comprising: a signal level range determination means for digitally processing an input signal to determine a signal level range of the input signal for every prescribed frame number unit; a driving power-supply voltage control means for controlling a driving power-supply voltage of the active display based upon a determination result by the signal level range determination means; and an input signal correction means for correcting an input signal level based upon a determination result by the level range detection means.

As the driving power-supply voltage control means, for example, a means is used by which the driving power-supply voltage is set low when the signal level range determined by the signal level range determination means is the entire level range except for a high luminance part, whereas the driving power-supply voltage is set high when the signal level range determined by the signal level range determination means is the entire level range except for a low luminance part.

As the input signal correction means, for example, a means is used by which an input signal is corrected such that the signal level range is extended to the high luminance side when the signal level range determined by the signal level range determination means is the entire level range except for a high luminance part, whereas the input signal is corrected such that the signal level range is extended to the low luminance side when the signal level range determined by the signal level range determination means is the entire level range except for a low luminance part.

The display device may comprise a scene change detection means, and the signal level range determination means may update the determination result of the signal level range of the input signal only when a scene change is detected by the scene change detection means.

BRIEF DESCRIPTION OF THE DRAWINGS

FIG. 9*a* is a graph showing the result of the control in the first conventional example; FIG. 9*b* is a graph showing the result of the control in a method of the present invention (present method).

FIG. 10*a* is a graph showing the result of the control in the first conventional example; FIG. 10*b* is a graph showing the result of the control in the present method.

FIG. 11*a* is a graph showing the result of the control in the first conventional example; FIG. 11*b* is a graph showing the result of the control in the present method.

FIG. 14*a* is a graph showing the result of the control in the second conventional example; FIG. 14*b* is a graph showing the result of the control in the present method.

FIG. 15*a* is a graph showing the result of the control in the second conventional example; FIG. 15*b* is a graph showing the result of the control in the present method.

FIG. 22*a* is a graph showing the result of the control in the conventional example; FIG. 22*b* is a graph showing the result of the control in the present method.

FIG. 23*a* is a graph showing the result of the control in the conventional example; FIG. 23*b* is a graph showing the result of the control in the present method.

FIG. 24*a* is a graph showing the result of the control in the conventional example; FIG. 24*b* is a graph showing the result of the control in the present method.

DESCRIPTION OF THE PREFERRED EMBODIMENTS

In the following, examples of the present invention are described by reference to FIGS. 5 to 24.

[A] EXAMPLE 1

First, an example in the case of applying this example to a passive display is described.

[1] Description of Concept of the Present Invention

It is assumed that, when a signal level is expressed by eight bits, the minimum value of the signal level in one screen is 128 and the maximum value thereof is 255.

Figure 1:
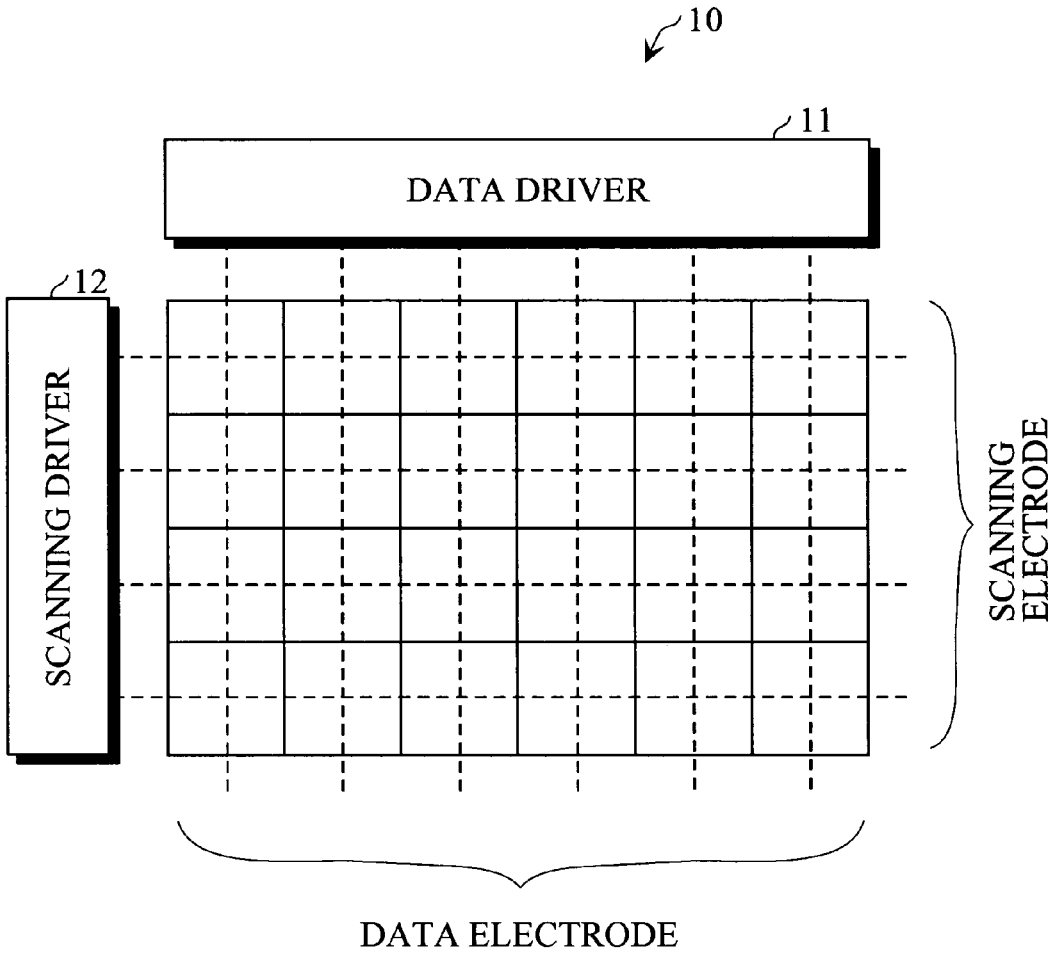
FIG. 1 is a block diagram showing a configuration of a self light-emitting display.
Figure 2:
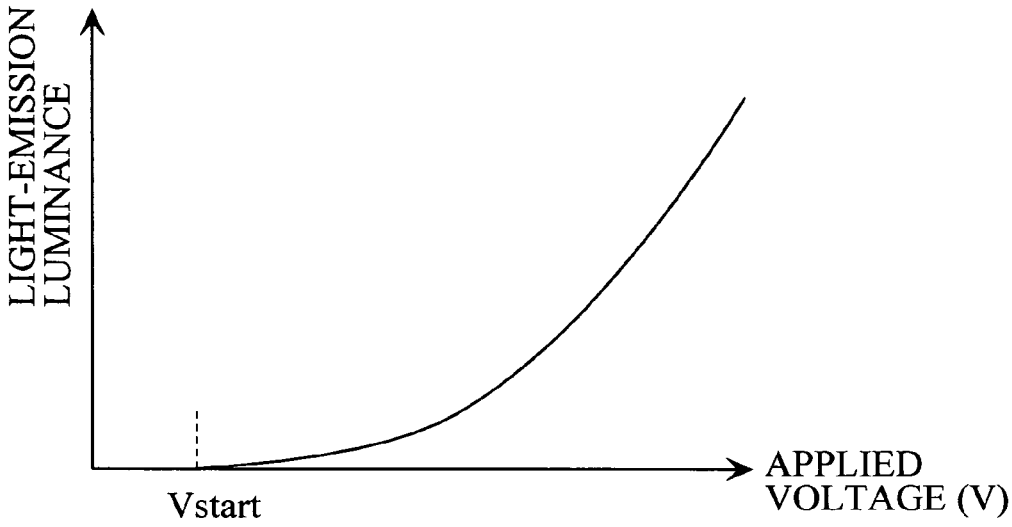
FIG. 2 is a graph showing a light-emitting characteristic of a self light-emitting element for use in the self light-emitting display.
Figure 3:
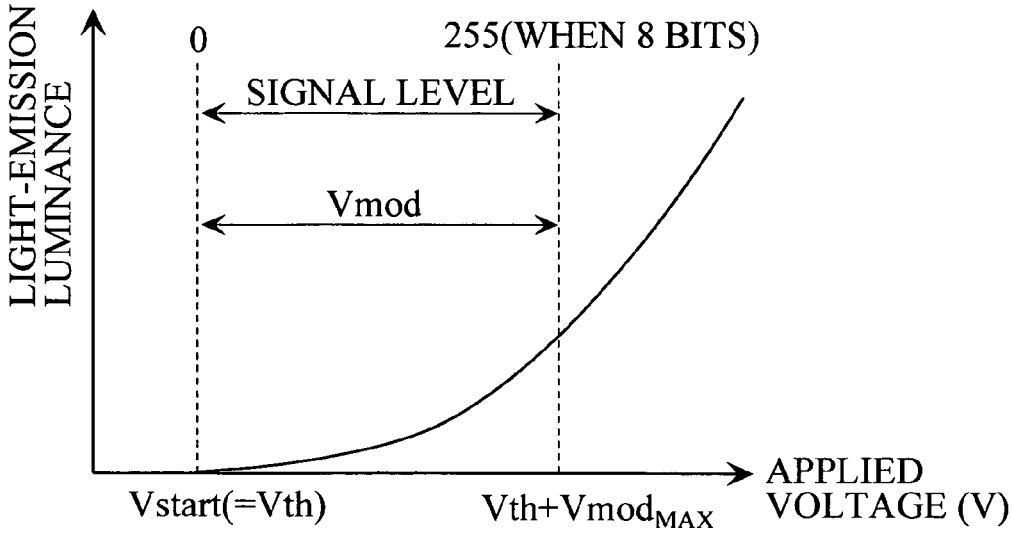
FIG. 3 is a graph showing a relationship among a threshold voltage, a modulating voltage and a signal level when the threshold voltage "Vth" is set to a light-emission starting voltage "Vstart".
Figure 5:
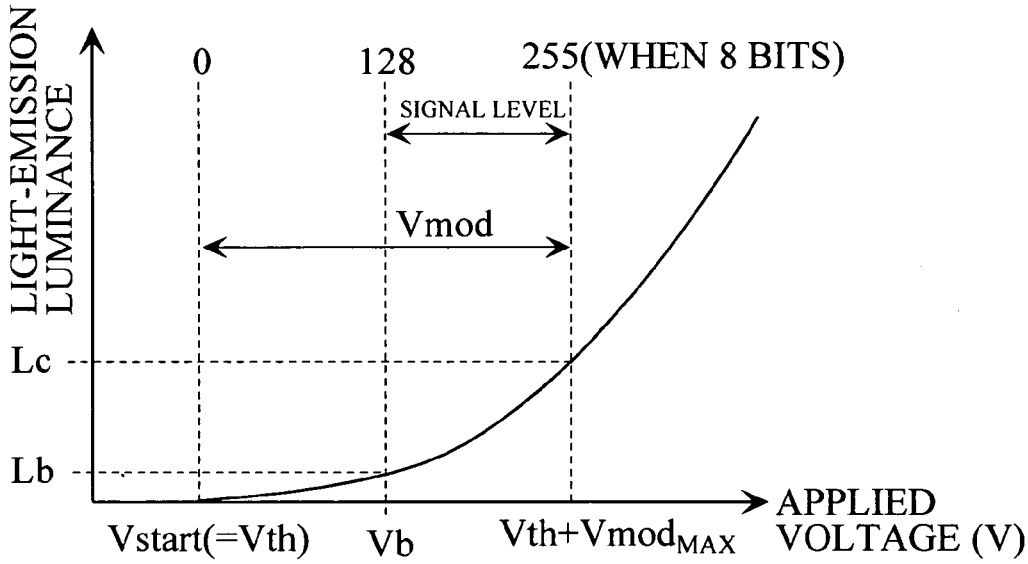
FIG. 5 is a graph showing an example of control in a first conventional example shown in FIG. 3.

FIG. 5 shows an example of the control in the first conventional example shown in FIG. 3. In the first conventional example, the threshold voltage "Vth" is set to the light-emission starting voltage "Vstart". As shown in FIG. 5, in the frame, the applied voltage to the light-emitting element is "Vb" when the signal level is the minimum value (128) of the frame, whereas the applied voltage to the light-emitting element is "$Vth+Vmod_{MAX}$" when the signal level is the maximum value (255) of the frame. Accordingly, the range of the light-emission luminance is the luminance range of "Lb" to "Lc", which corresponds to the range of the applied voltage of "Vb" to "$Vth+Vmod_{MAX}$".

Figure 6:
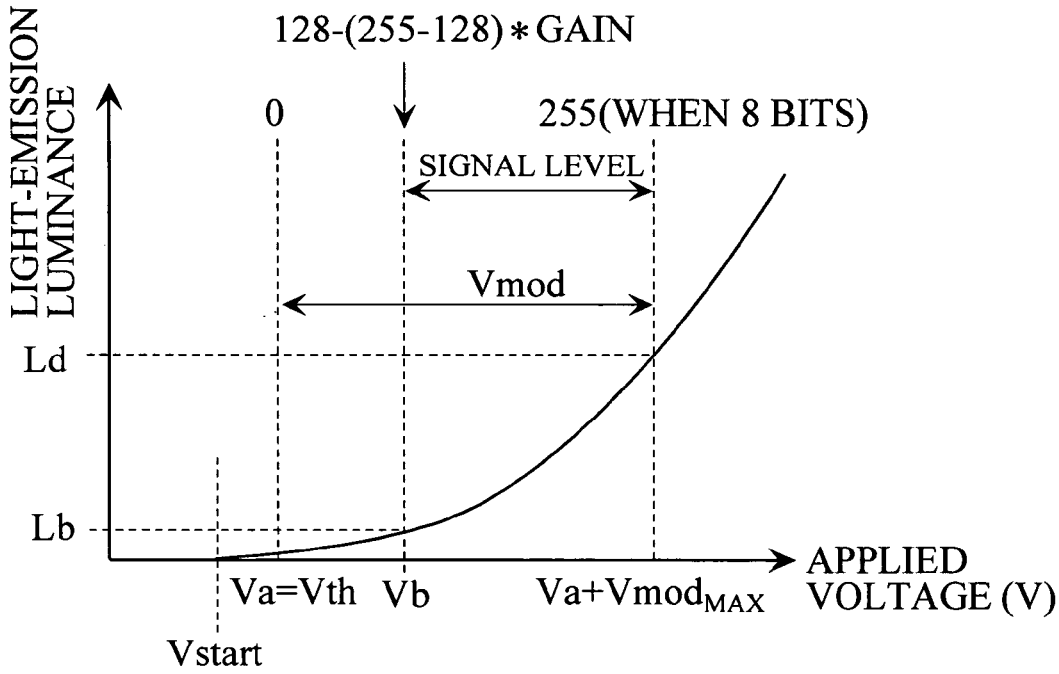
FIG. 6 is a graph showing a concept of the present invention.

In the present invention, as shown in FIG. 6, the threshold voltage "Vth" is set to "Va" which is a higher value than the light-emission starting voltage "Vstart". The signal level "S" is then corrected to "S−(255−S)×GAIN". As a result, when the signal level in this frame is the maximum value (255) of the frame, the applied voltage to the light-emitting element is "$Va+Vmod_{MAX}$". Further, when the signal level in this frame is the minimum value (128) of the frame, the applied voltage to the light-emitting element is "Vb", for example. Accordingly, the range of the light-emission luminance is the luminance range of "Lb" to "Ld", which corresponds to the range of the applied voltage of "Vb" to "$Va+Vmod_{MAX}$", thereby improving the luminance level.

[2] Description of Configuration of Display Device

Figure 7:
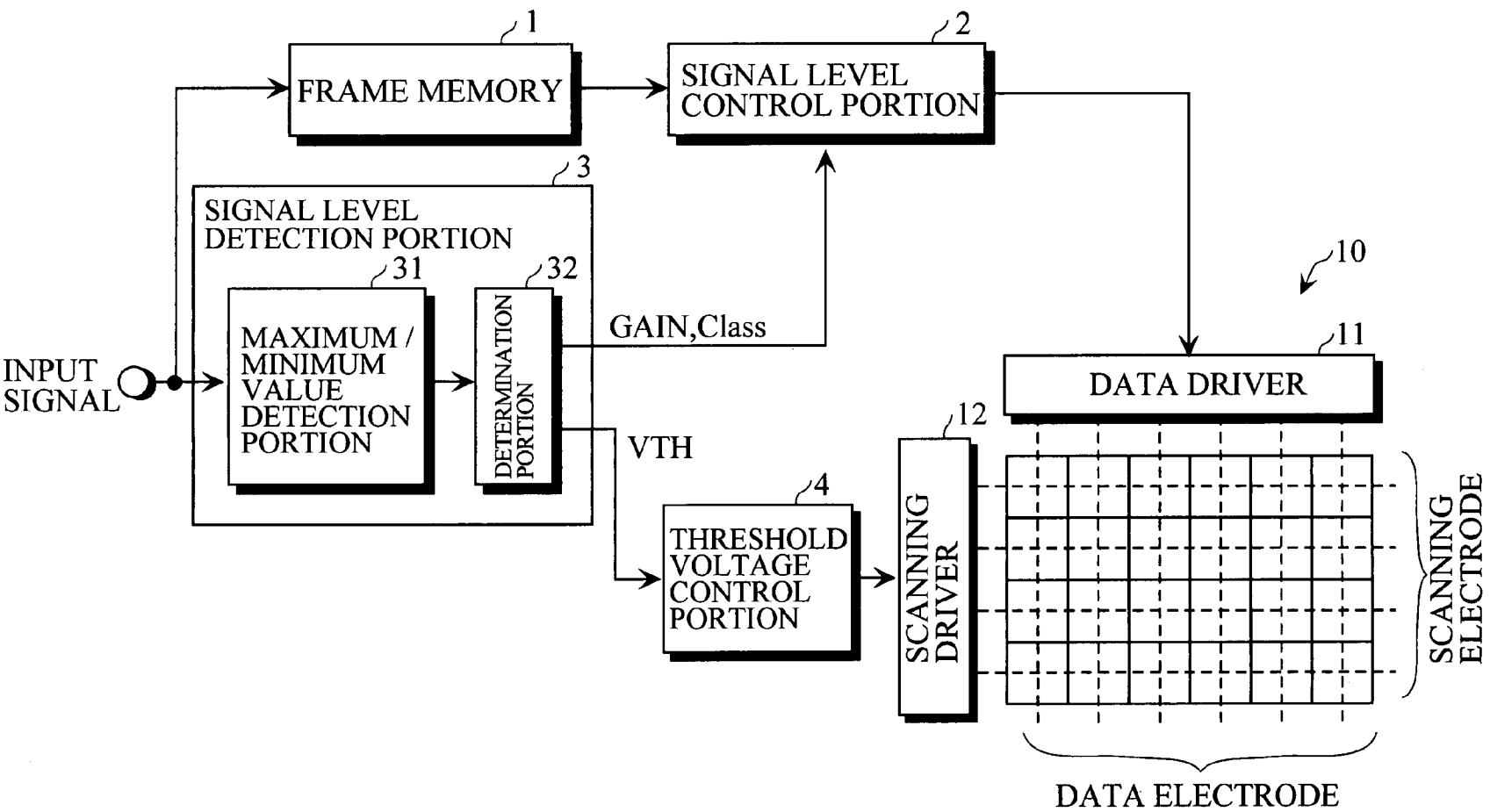
FIG. 7 is a block diagram showing an electric configuration of a display device comprising a self light-emitting display such as an inorganic EL display.

FIG. 7 shows an electric configuration of a display device comprising a self light-emitting display such as an inorganic EL display.

An input signal (8-bit digital signal) is sent to a signal level detection portion (signal level range determination means) 3, as well as to a frame memory 1. The input signal stored in the frame memory 1 is sent to a data driver 11 of a self light-emitting display 10 after the signal level has been corrected by a signal level control portion (input signal correction means) 2. A scanning driver 12 of the self light-emitting display 10 is controlled by a threshold voltage control portion (threshold voltage control means) 4. The signal level detection portion 3 gives a control signal to the threshold voltage control portion 4 as well as to give a control signal to the signal level control portion 2.

[2-1] Description of Signal Level Detection Portion 3

The signal level detection portion 3 comprises a maximum/minimum value detection portion 31 and a determination portion 32. The maximum/minimum value detection portion 31 extracts the maximum value "MAX" and the minimum value "MIN" of an input signal for every one frame (or every several frames), and then gives the extracted values to the determination portion 32.

Based upon the maximum value "MAX" and the minimum value "MIN" given by the maximum/minimum value detection portion 31, the determination portion 32 produces a gain "GAIN" and a classification determination signal "Class", to be given to the signal level control portion 2, and a set value "VTH" for controlling a threshold voltage to be given to the threshold voltage control portion 4. The gain "GAIN" is a coefficient for correcting an input signal. The classification determination signal "Class" is a determination signal for indicating a classification determined based upon the maximum value "MAX" and the minimum value "WIN". The set value "VTH" is a set value for determining a threshold voltage "Vth".

Figure 8:
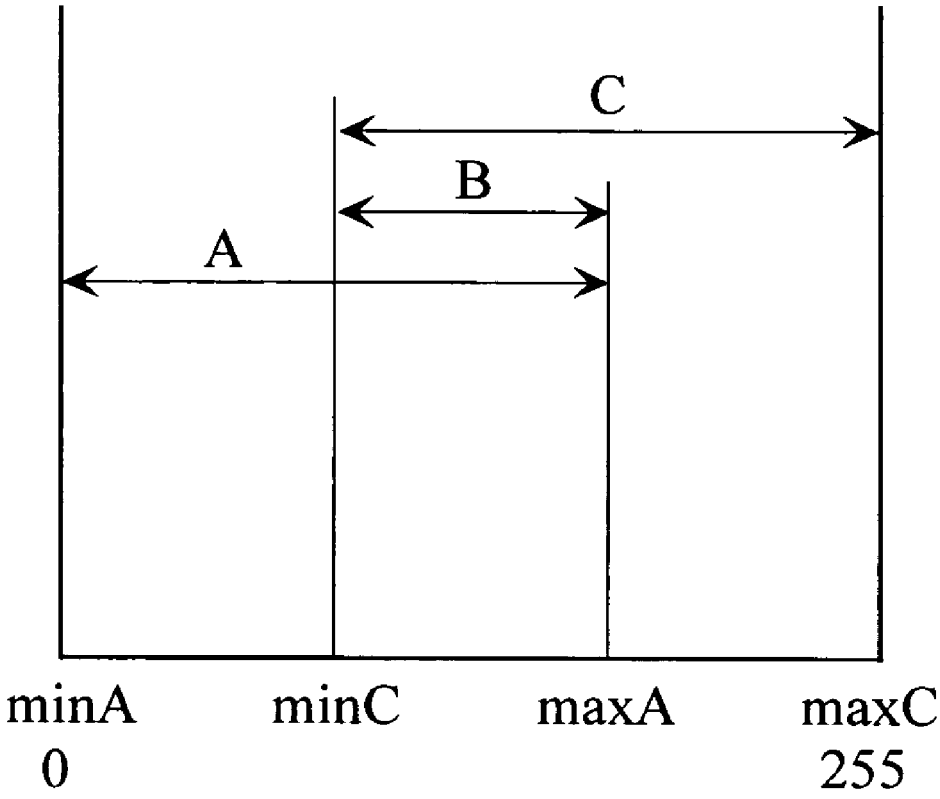
FIG. 8 is a schematic diagram for describing an action of a determination portion 32 in a signal level detection portion 3.

The action of the determination portion 32 is described. As shown in FIG. 8, based upon the signal maximum value "MAX", the signal minimum value "MIN", and previously set standard values: minA, maxA, minC and maxC in one frame, the determination portion 32 first determines to which of four classifications: A, B, C and D, a range where the signal maximum value "MAX" and the signal minimum value "MIN" are present belongs.

As shown in FIG. 8, each of the standard values: minA, maxA, minC and maxC, has been set such that the relationship: 0=minA<minC<maxA<maxC=255, is maintained in the range (0 to 255) where an input signal can be present.

When the signal maximum value "MAX" and the signal minimum value "MIN" in one frame are present in a range not smaller than "minC" and not larger than "maxA", the classification of this range is determined to be "B". The classification B represents the case where the range of the signal level in one frame is in the intermediate part of the entire level range.

When the signal maximum value "MAX" and the signal minimum value "MIN" in one frame are present in a range not smaller than "minA" and not larger than "maxA", and the classification B does not apply, the classification of the range is determined to be "A". The classification A represents the case where the range of the signal level in one frame is the entire level range except for a high luminance part.

When the signal maximum value "MAX" and the signal minimum value "MIN" in one frame are present in a range not smaller than "minC" and not larger than "maxC", and the classification B does not apply, the classification of the range is determined to be "C". The classification C represents the case where the range of the signal level in one frame is the entire level range except for a low luminance part.

When none of the classifications A, B and C applies, the classification of the range is determined to be "D". The classification D represents the case where the range of the signal level in one frame is a broad range from the low luminance part through the high luminance part.

Next, based upon the classification results, the determination portion 32 determines a classification determination signal "Class", a gain "GAIN", and a set value "VTH" as follows:

When the classification result is "B":
Class=2, GAIN=Gb, VTH=Vthb

When the classification result is "A":
Class=0, GAIN=Ga, VTH=Vtha

When the classification result is "C":
Class=1, GAIN=Gc, VTH=Vthc

When the classification result is "D":
Class=0, GAIN=0, VTH=Vthd

Herein, the scales of the set values are expressed by: Vtha (=Vthd)<Vthb<Vthc. It is to be noted that, in this example, "Vtha" is assumed to have been set to the light-emission starting voltage "Vstart". "Ga", "Gb" and "Gc" are set to values in a range larger than 0 and smaller than 1.

[2-2] Description Of Signal Level Control Portion 2

The action of the signal level control portion 2 is described. The signal level control portion 2 corrects a level of an input signal "S" based upon the classification determination signal "Class" and the gain "GAIN", given by the signal level detection portion 3, using the following formula (1). Herein, "SS" represents a signal after the correction (an output signal of the signal level control portion 2).

When Class=0 (the classification is "A" or "D")

$$SS=S+S*\text{GAIN}$$

When Class=1 (the classification is "C")

$$SS=S-(255-S)*\text{GAIN}$$

When Class=2 (the classification is "B")

$$SS=S-(\text{Max}-S)*\text{GAIN} \quad (1)$$

When Class=1, the correction formula in the case of Class=2 may be used. Although "GAIN" is set by classification in the above example, "GAIN" may be set more adaptively according to the maximum value and the minimum value in one screen. It should be noted that, although the signal level control portion 2 produces the output signal "SS" based upon the above formula (1), tables representing a relation between the input signal "S" and the output signal "SS" in the respective cases of Class=0, Class=1 and Class=2 may be previously prepared, and based upon these tables, the input signal "S" may be corrected.

[2-3] Description of Threshold Voltage Control Portion 4

The action of the threshold voltage control portion 4 is described. The threshold voltage control portion 4 controls a threshold voltage, based upon the set value "VTH" given by the signal level detection portion 3. That is, when the classification result is "B", "VTH" is equivalent to "Vthb", and thus the scanning driver 12 is controlled such that the threshold voltage "Vth" becomes equivalent to "Vthb". When the classification result is "A", "VTH" is equivalent to "Vtha", and thus the scanning driver 12 is controlled such that the threshold voltage "Vth" becomes equivalent to "Vtha". When the classification result is "C", VTH is equivalent to "Vthc", and thus the scanning driver 12 is controlled such that the threshold voltage "Vth" becomes equivalent to "Vthc". When the classification result is "D", "VTH" is equivalent to "Vthd", and thus the scanning driver 12 is controlled such that the threshold voltage "Vth" becomes equivalent to "Vthd".

[3] Description of Control Results

Figure 9A:
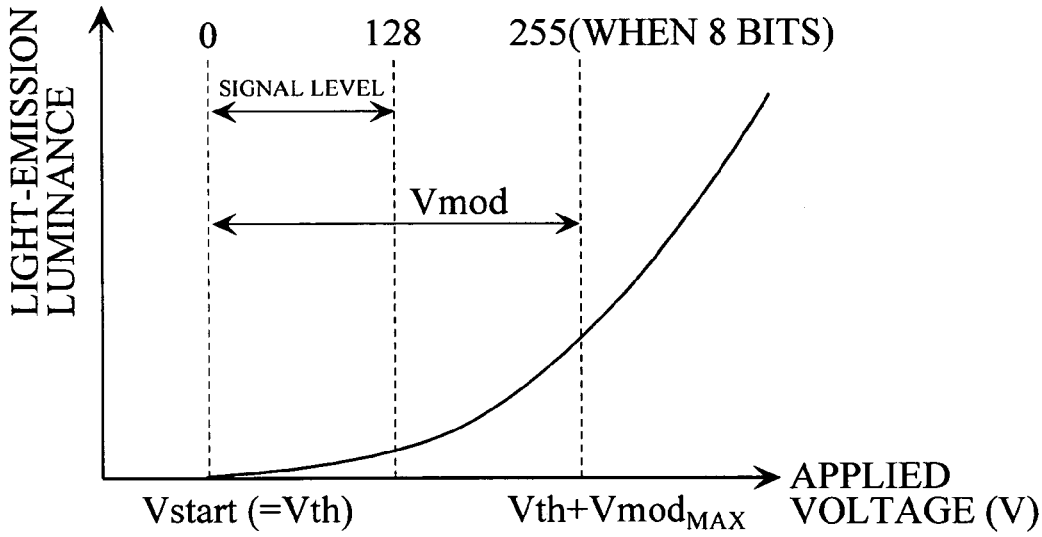
FIGS. 9*a* and 9*b* show results of controls when the classification result is "A".
Figure 9B:
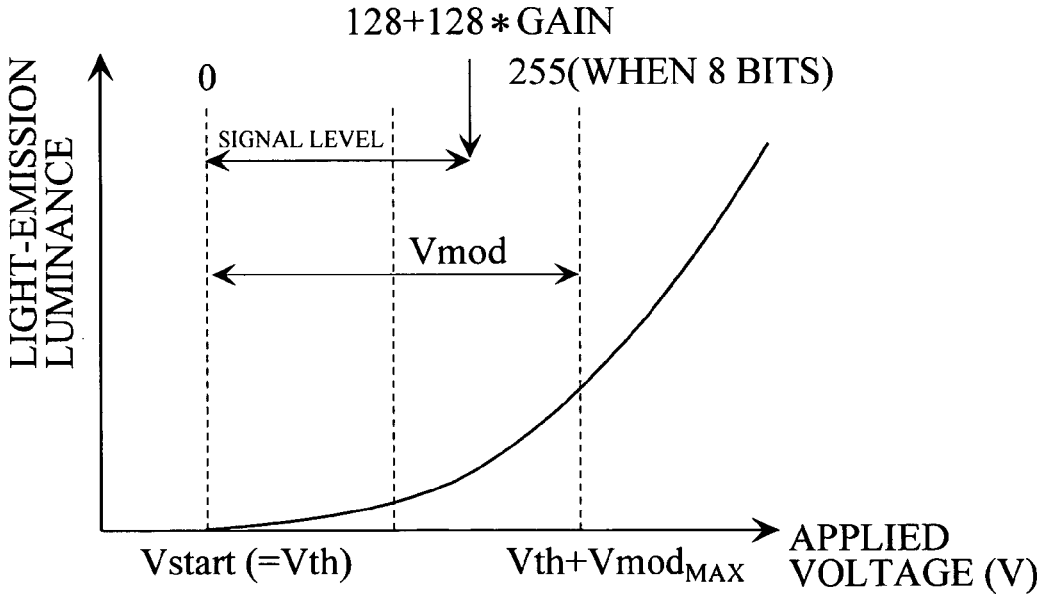

The result of the control of (MIN=0, MAX=128) when the classification result is "A" is described. FIG. 9*a* shows the result of the control in the first conventional example described using FIG. 3. FIG. 9*b* shows the result of the control in the example of the present invention (hereinafter referred to as the present method).

In the first conventional example, the input signal level is not corrected, whereas in the present method, the input signal "S" is corrected based upon the formula: SS=S+S*GAIN, and the range of the input signal level is thus extended to the high luminance side. It is thereby possible in the present method to make the luminance higher than that of the first conventional example.

Figure 10A:
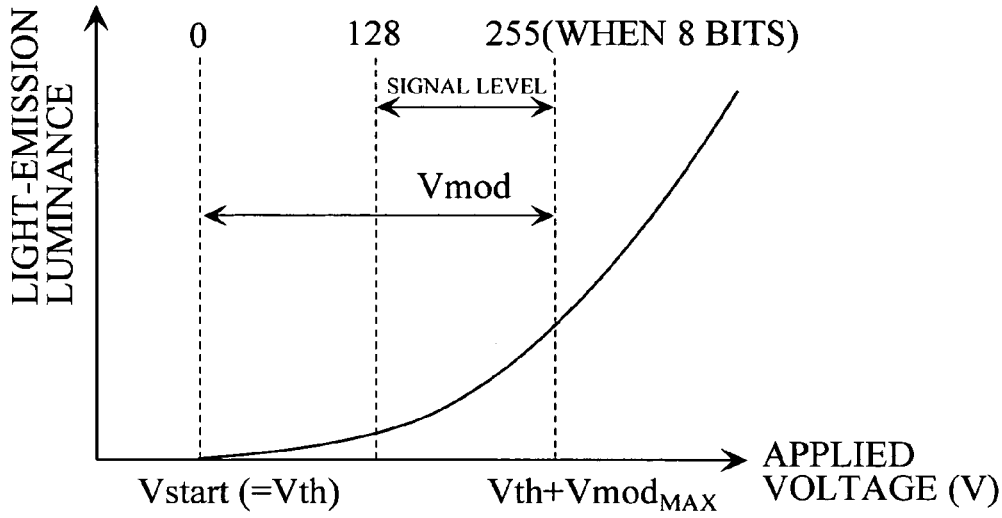
FIGS. 10*a* and 10*b* show results of controls when the classification result is "C".
Figure 10B:
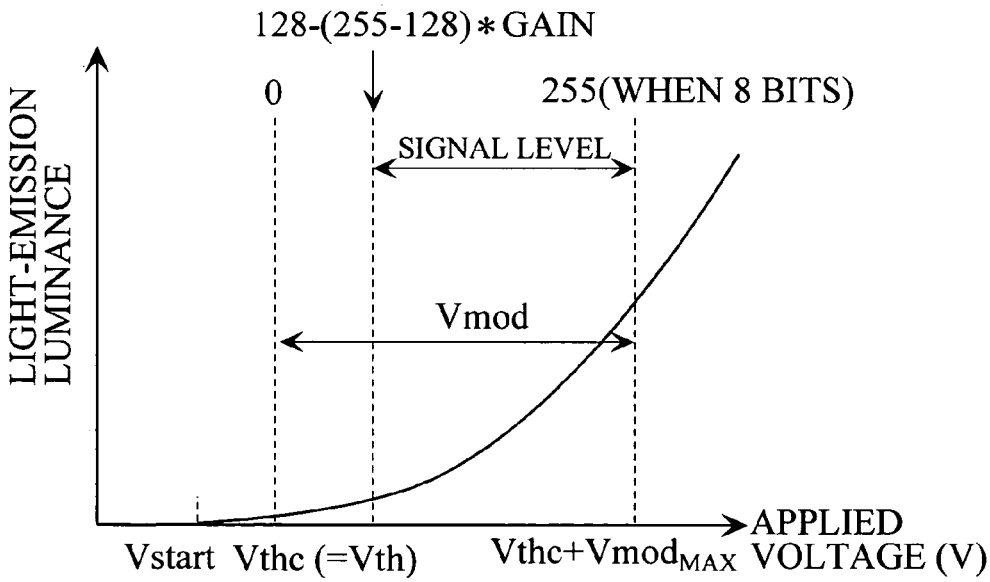

The result of the control of (MIN=128, MAX=255) when the classification result is "C" is described. FIG. 10*a* shows the result of the control in the first conventional example described using FIG. 3. FIG. 10*b* shows the result of the control in the example of the present invention (hereinafter referred to as the present method).

In the first conventional example, the threshold voltage "Vth" is set to "Vstart", whereas in the present method, the threshold voltage "Vth" is set to "Vthc" (>Vstart). Further, in the present method, since the input signal "S" is corrected based upon the formula: SS=S−(255−S)*GAIN, the range of the input signal level is extended to the low luminance side. It is thereby possible in the present method to increase the light-emission luminance on the high luminance side so as to improve contrast.

Figure 11A:
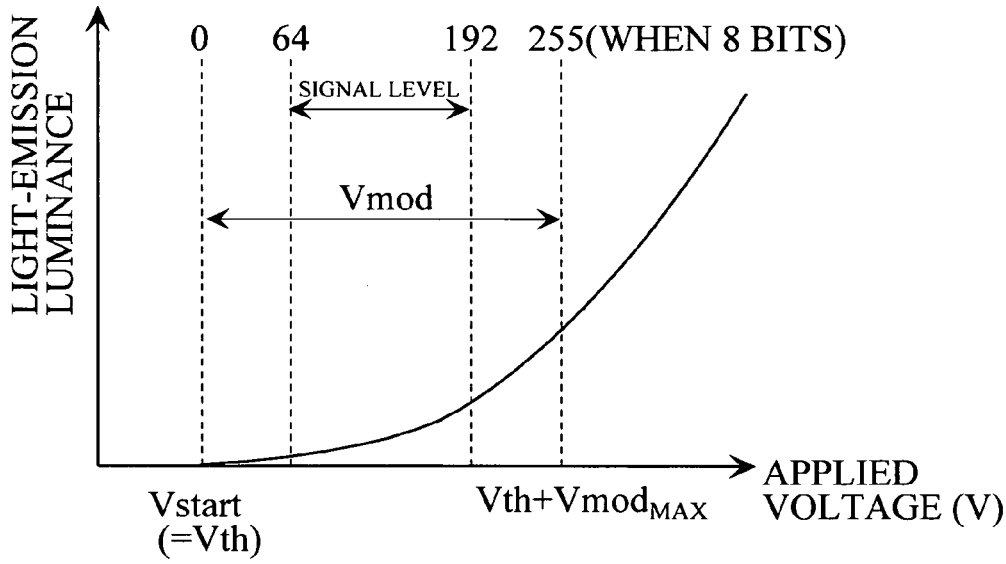
FIGS. 11*a* and 11*b* show results of controls when the classification result is "B".
Figure 11B:
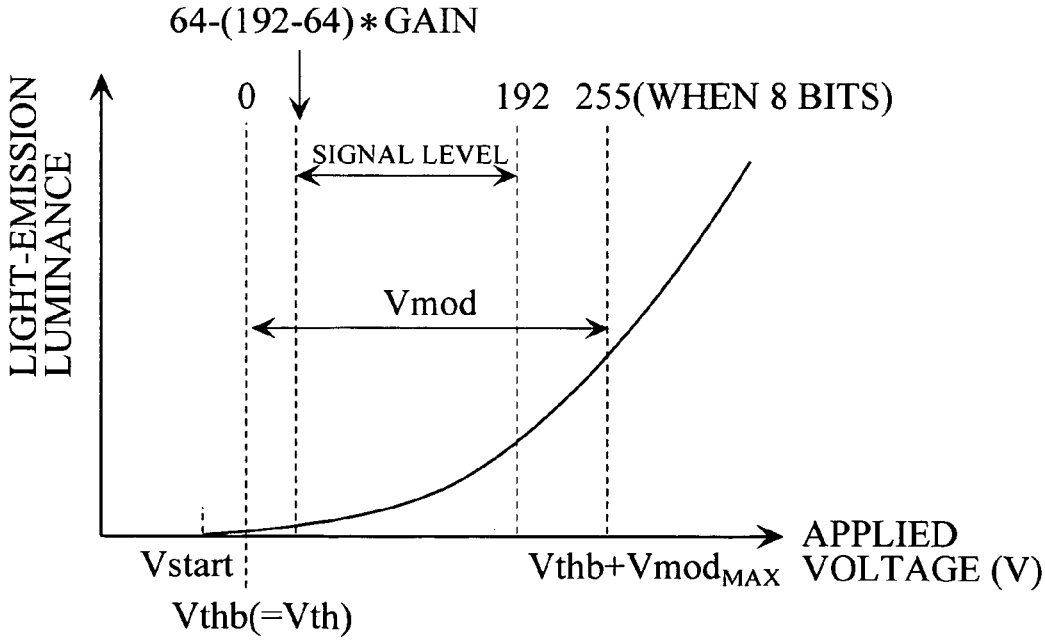

The result of the control of (MIN=64, MAX=192) when the classification result is "B" is described. FIG. 11*a* shows the result of the control in the first conventional example described using FIG. 3. FIG. 11*b* shows the result of the control in the example of the present invention (hereinafter referred to as the present method).

In the first conventional example, the threshold voltage "Vth" is set to "Vstart", whereas in the present method, the threshold voltage "Vth" is set to "Vthb" (>Vstart). Further, in the present method, since the input signal "S" is corrected based upon the formula: SS=S−(MAX−S)*GAIN, the range of the input signal level is extended to the low luminance side. Further, in the present method, the light-emission luminance is higher on the high luminance side than in the conventional example, due to the shift of "Vth". It is thereby possible in the present method to increase the light-emission luminance on the high luminance side so as to improve contrast.

[B] EXAMPLE 2

[1] Description of Concept of the Present Invention

It is assumed that, when a signal level is expressed by eight bits, the minimum value of the signal level in one screen is 0 and the maximum value thereof is 128.

Figure 4:
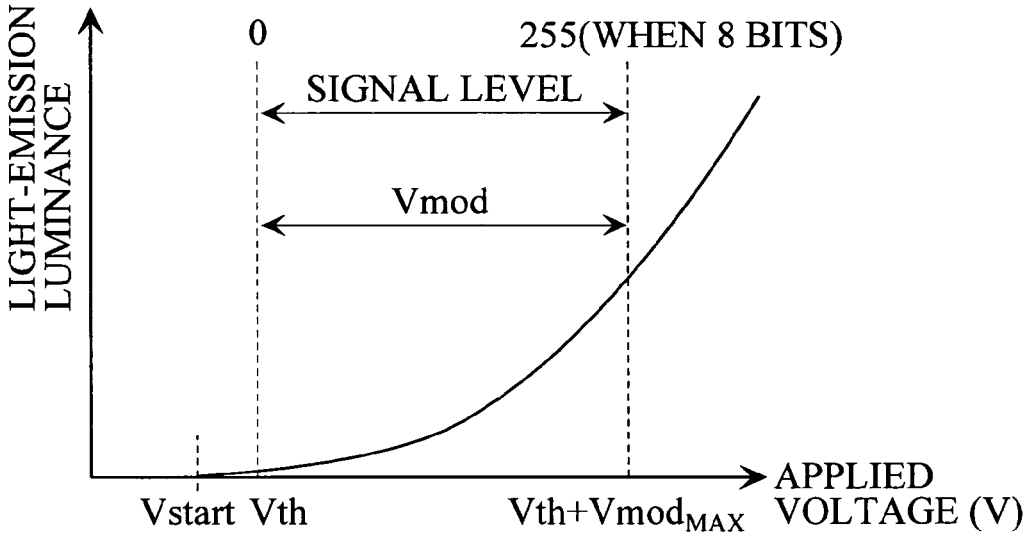
FIG. 4 is a graph showing the relationship among the threshold voltage, the modulating voltage and the signal level when the threshold voltage "Vth" is set higher than the light-emission starting voltage "Vstart".
Figure 12:
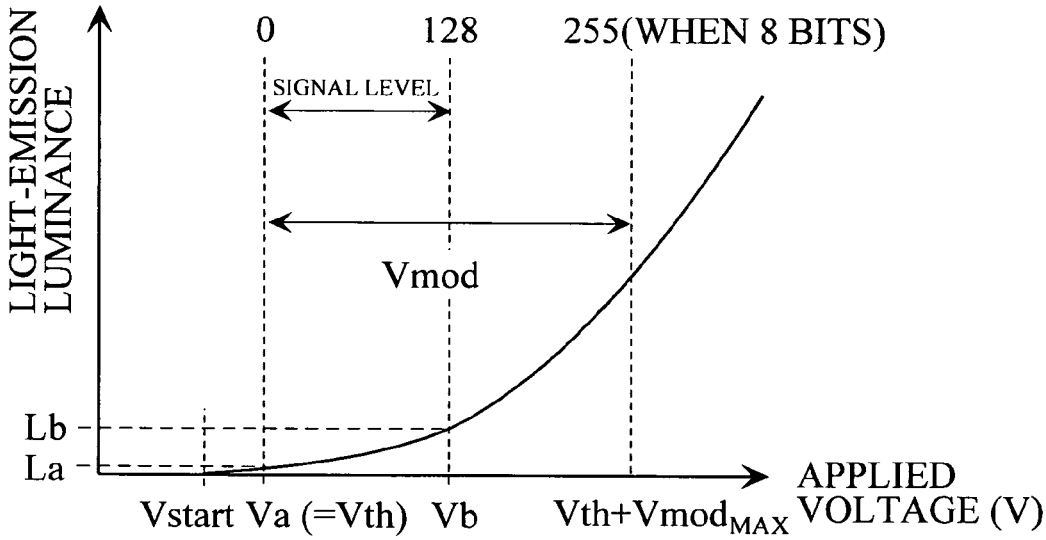
FIG. 12 is a graph showing an example of control in a second conventional example shown in FIG. 4.

FIG. 12 shows an example of control in the second conventional example shown in FIG. 4. In the second conventional example, the threshold voltage "Vth" is set to "Va" which is a higher value than the light-emission starting voltage "Vstart". As shown in FIG. 12, in the frame, the applied voltage to the light-emitting element is "Va" when the signal level is the minimum value (0) of the frame, whereas the applied voltage is "Vb" when the signal level is the maximum value (128) of the frame. Accordingly, the range of the light-emission luminance is the luminance range of "La" to "Lb", which corresponds to the range of the applied voltage of "La" to "Vb".

Figure 13:
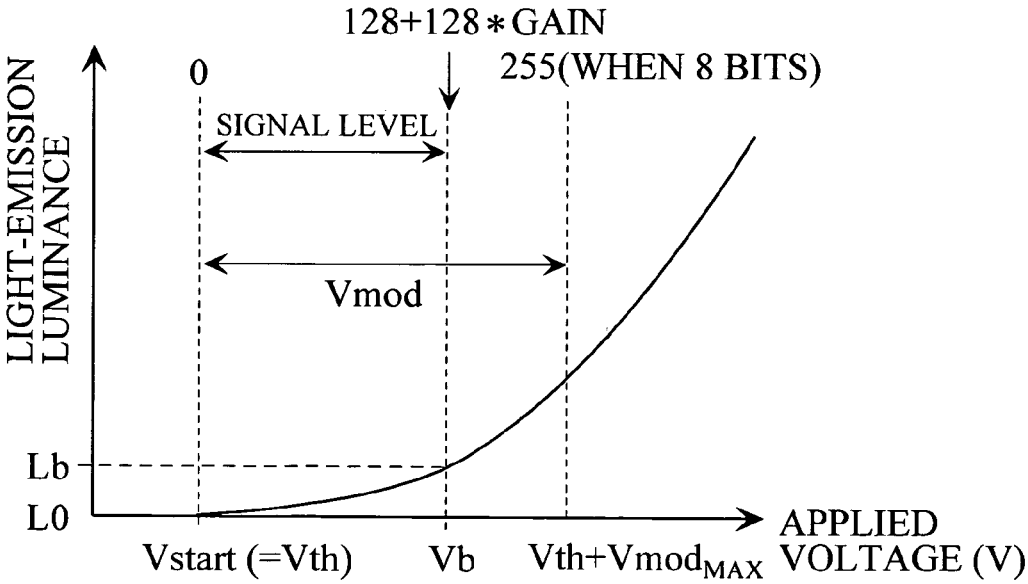
FIG. 13 is a graph showing a concept of the present invention.

In the present invention, as shown in FIG. 13, the threshold voltage "Vth" is set to the light-emission starting voltage "Vstart". The signal level "S" is then corrected to "S+S*GAIN". As a result, when the signal level in this frame is the minimum value (0) of the frame, the applied voltage to the light-emitting element is "Vstart (V0)". Further, when the signal level in this frame is the maximum value (128) of the frame, the applied voltage to the light-emitting element is "Vb". Accordingly, the range of the light-emission luminance is the luminance range of "L0" to "Lb", which corresponds to the range of the applied voltage of "V0" to "Vb", thereby improving contrast.

[2] Description of Configuration of Display Device

The configuration of the display device is the same as that of Example 1. Namely, the display device is configured as shown in FIG. 7. However, the process of the determination portion 32 in the signal level detection portion 3 and the process of the signal level control portion 2 are different from those in Example 1.

[2-1] Description of Signal Level Detection Portion 3

The signal level detection portion 3 comprises a maximum/minimum value detection portion 31 and a determination portion 32. The maximum/minimum value detection portion 31 extracts the maximum value "MAX" and the minimum value "MIN" of an input signal for every one frame, and then gives the extracted values to the determination portion 32.

Based upon the maximum value "MAX" and the minimum value "MIN" given by the maximum/minimum value detection portion 31, the determination portion 32 produces a gain "GAIN" and a classification determination signal "Class", to be given to the signal level control portion 2, and a set value "VTH" for controlling a threshold voltage to be given to the threshold voltage control portion 4. The gain "GAIN" is a coefficient for correcting an input signal. The classification determination signal "Class" is a determination signal for indicating a classification determined based upon the maximum value "MAX" and the minimum value "MIN". The set value "VTH" is a set value for determining a threshold voltage "Vth".

The action of the determination portion 32 is described. As shown in FIG. 8, based upon the signal maximum value "MAX", the signal minimum value "MIN", and previously set standard values: minA, maxA, minC and maxC in one frame, the determination portion 32 first determines to which of four classifications: A, B, C and D, a range where the signal maximum value "MAX" and the signal minimum value "MIN" are present belongs.

As shown in FIG. 8, each of the standard values: minA, maxA, minC and maxC, has been set such that the relationship: 0=minA<minC<maxA<maxC=255, is maintained in the range (0 to 255) where an input signal can be present.

When the signal maximum value "MAX" and the signal minimum value "MIN" in one frame are present in a range not smaller than "minC" and not larger than "maxA", the classification of this range is determined to be "B". The classification B represents the case where the range of the signal level in one frame is in the intermediate part of the entire level range.

When the signal maximum value "MAX" and the signal minimum value "MIN" in one frame are present in a range not smaller than "minA" and not larger than "maxA", and the classification B does not apply, the classification of the range is determined to be "A". The classification A represents the case where the range of the signal level in one frame is the entire level range except for a high luminance part.

When the signal maximum value "MAX" and the signal minimum value "MIN" in one frame are present in a range not smaller than "minC" and not larger than "maxC", and the classification B does not apply, the classification of the range is determined to be "C". The classification C represents the case where the range of the signal level in one frame is the entire level range except for a low luminance part.

When none of the classifications A, B and C applies, the classification of the range is determined to be "D". The classification D represents the case where the range of the signal level in one frame is a broad range from the low luminance part through the high luminance part.

Next, based upon the classification results, the determination portion 32 determines a classification determination signal "Class", a gain "GAIN", and a set value "VTH" as follows:

When the classification result is "B" or "D":
Class=0, GAIN=0, VTH=Vthb

When the classification result is "A":
Class=0, GAIN=Ga, VTH=Vtha

When the classification result is "C":
Class=1, GAIN=Gb, VTH=Vthc

Herein, the scales of the set values are expressed by: Vtha<Vthb<Vthc. It is to be noted that, in this example, "Vtha" is assumed to have been set to the light-emission starting voltage "Vstart". "Ga" and "Gb" are set to values in a range not smaller than 0 and not larger than 1.

[2-2] Description of Signal Level Control Portion 2

The action of the signal level control portion 2 is described. The signal level control portion 2 corrects a level of an input signal "S" based upon the classification determination signal "Class" and the gain "GAIN", given by the signal level detection portion 3, using the following formula (2). Herein, "SS" represents a signal after the correction (an output signal of the signal level control portion 2).

When Class=0 (the classification is "A", "B" or "D")

$$SS=S+S*\text{GAIN}$$

When Class=1 (the classification is "C")

$$SS=S-(255-S)*\text{GAIN} \quad (2)$$

It is to be noted that, although the signal level control portion 2 produces the output signal "SS" based upon the above formula (2), tables representing a relation between the input signal "S" and the output signal "SS" in the respective cases of Class=0 and Class=1 may be previously prepared, and based upon these tables, the input signal "S" may be corrected.

[2-3] Description of Threshold Voltage Control Portion 4

The action of the threshold voltage control portion 4 is described. The threshold voltage control portion 4 controls a threshold voltage, based upon the set value "VTH" given by the signal level detection portion 3. That is, when the classification result is "B" or "D", "VTH" is equivalent to "Vthb", and thus the scanning driver 12 is controlled such that the threshold voltage "Vth" becomes equivalent to "Vthb". When the classification result is "A", "VTH" is equivalent to "Vtha", and thus the scanning driver 12 is controlled such that the threshold voltage "Vth" becomes equivalent to "Vtha". When the classification result is "C", VTH is equivalent to "Vthc", and thus the scanning driver 12 is controlled such that the threshold voltage "Vth" becomes equivalent to "Vthc".

[3] Description of Control Results

Figure 14A:
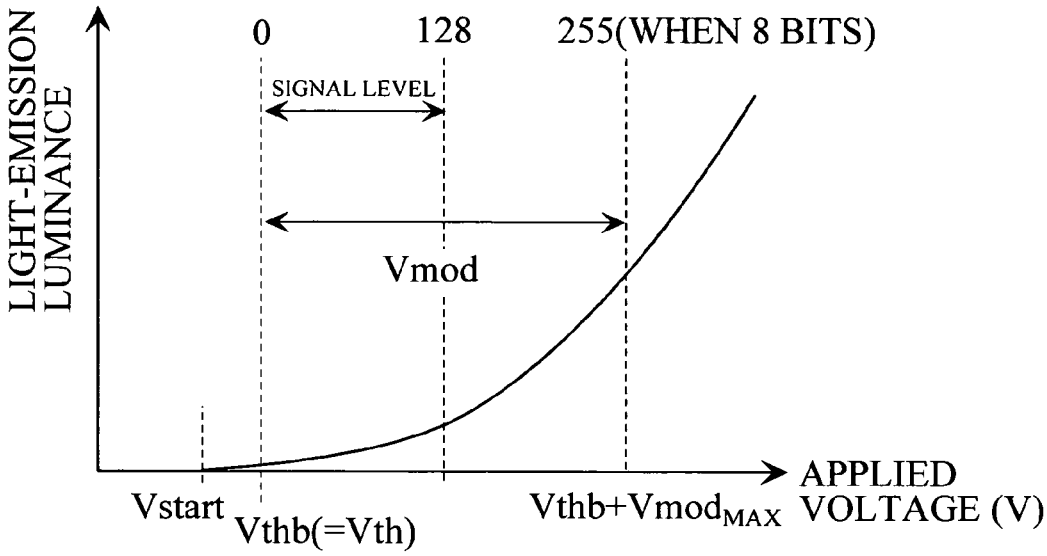
FIGS. 14*a* and 14*b* show results of controls when the classification result is "A".
Figure 14B:
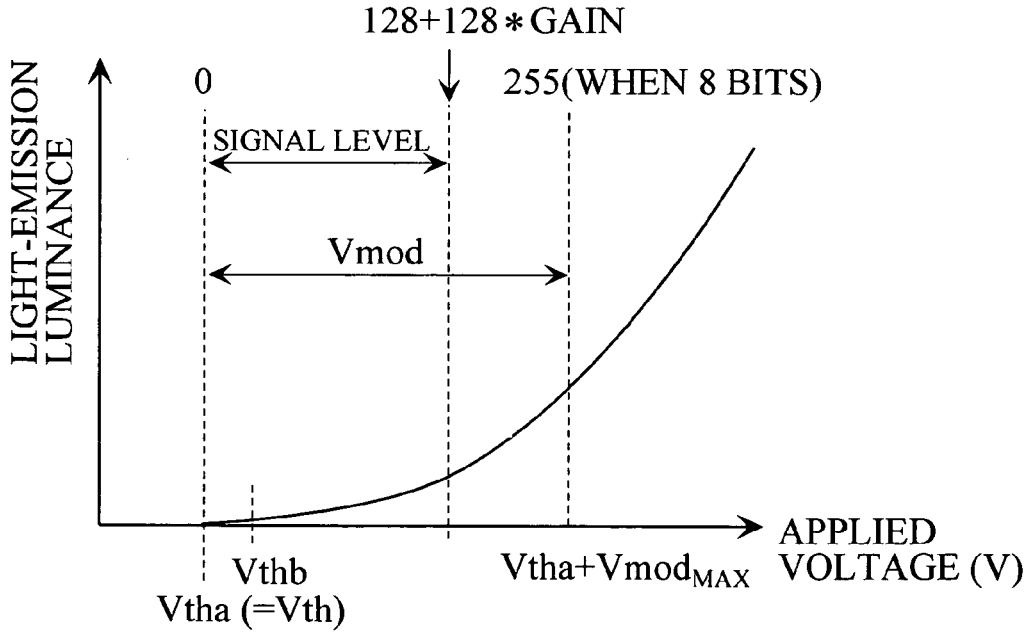

The result of the control of (MIN=0, MAX=128) when the classification result is "A" is described. FIG. 14*a* shows the result of the control in the second conventional example described using FIG. 4. FIG. 14*b* shows the result of the control in the example of the present invention (hereinafter referred to as the present method).

In the second conventional example, the threshold voltage "Vth" is set to "Vthb", which is a higher value than "Vstart", whereas in the present method, the threshold voltage "Vth" is set to "Vtha" (=Vstart<Vthb). Further, in the present method, since the input signal "S" is corrected based upon the formula: SS=S+S*GAIN, the range of the input signal level is extended to the high luminance side. It is thereby possible in the present method to decrease the light-emission luminance (reduce the black level) on the low luminance side so as to improve contrast.

Figure 15A:
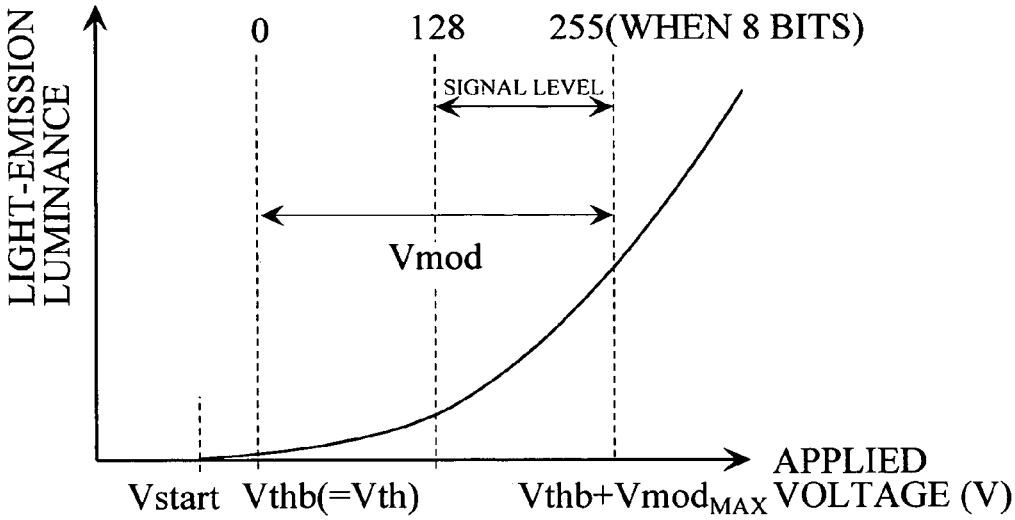
FIGS. 15*a* and 15*b* show results of controls when the classification result is "C".
Figure 15B:
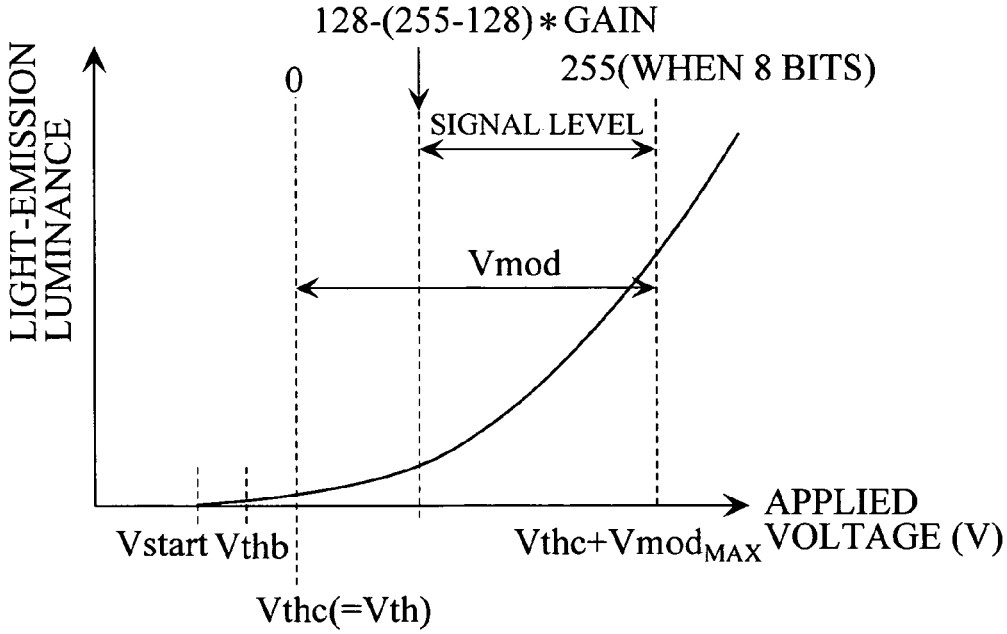

The result of the control of (MIN=128, MAX=255) when the classification result is "C" is described. FIG. 15*a* shows the result of the control in the second conventional example described using FIG. 4. FIG. 15*b* shows the result of the control in the example of the present invention (hereinafter referred to as the present method).

In the second conventional example, the threshold voltage "Vth" is set to "Vthb", whereas in the present method, the threshold voltage "Vth" is set to "Vthc" (>Vthb). Further, in the present method, since the input signal "S" is corrected based upon the formula: SS=S−(255−S)*GAIN, the range of the input signal level is extended to the low luminance side. It is thereby possible in the present method to increase the light-emission luminance on the high luminance side so as to improve contrast.

It is to be noted that, when the classification result is "B" or "D", "SS" is equivalent to "S" and "VTH" is equivalent to "Vthb", and thus the result of the control in the present method is the same as that in the second conventional example.

Although, in above Examples 1 and 2, the input signal level is corrected and the threshold voltage "Vth" is controlled by calculating "Class", "GAIN" and "VTH" in units of one frame, such correction and control may also be performed by calculating "Class", "GAIN" and "VTH" in units of one horizontal line.

[C] EXAMPLE 3

In Examples 1 and 2, although the signal level detection portion 3 updates the signal level detection result ("Class", "GAIN" and "VTH") for every one frame (every several frames), the signal level detection portion 3 may be arranged to update the signal level detection result ("Class", "GAIN" and "VTH") only when a scene change is detected.

Figure 16:
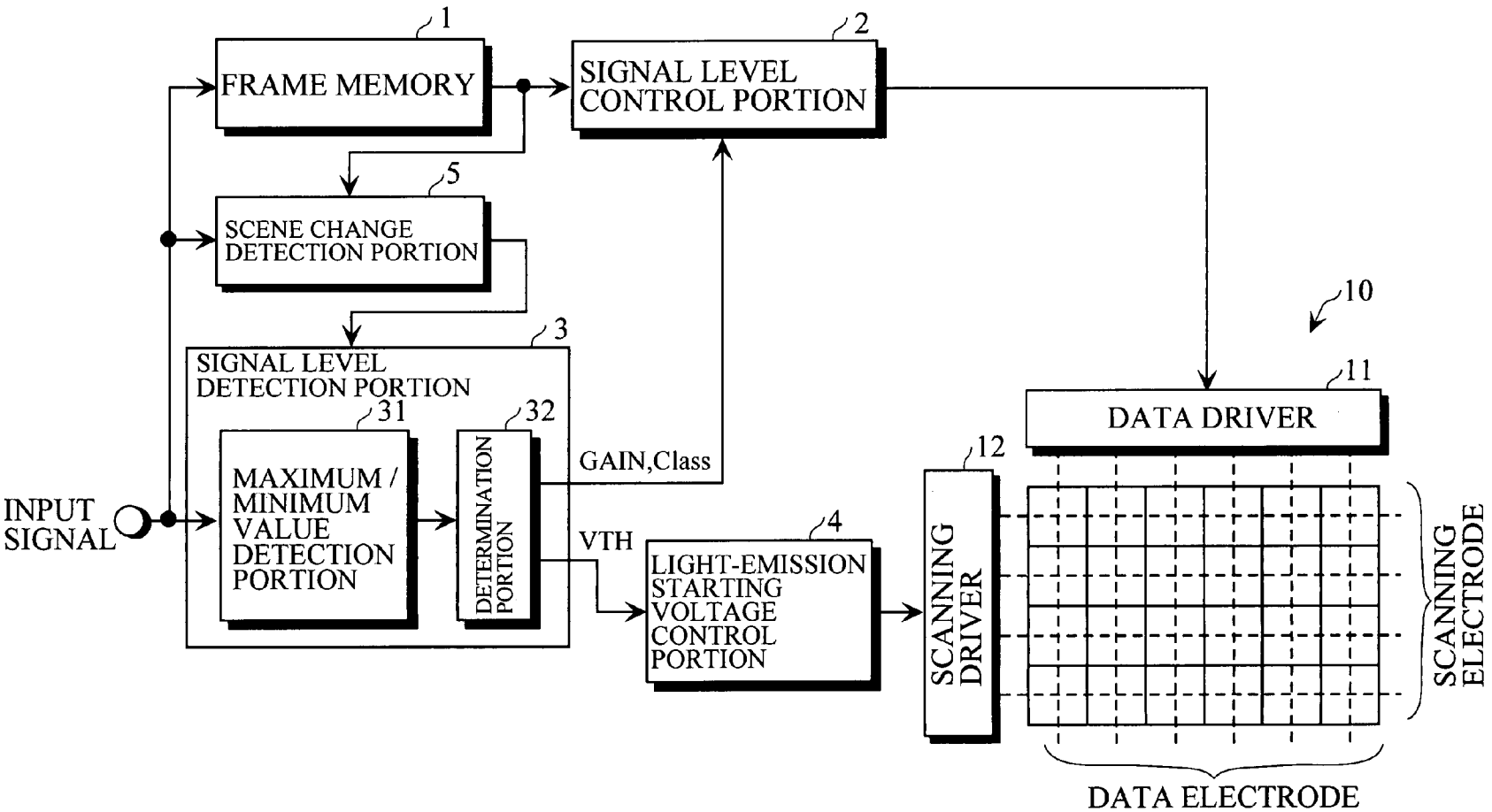
FIG. 16 is a block diagram showing an electric configuration of a display device according to a third example.

FIG. 16 shows an electric configuration of a display device. In FIG. 16, the same constituents as those in FIG. 7 are provided with the same reference numerals as in FIG. 7. Hence descriptions of those constituents are omitted in FIG. 16.

In this display device, a scene change detection portion 5 is provided for detecting whether a scene has changed or not between the present frame and a frame immediately preceding to the present frame, based upon an input signal of the present frame and an input signal of the immediately preceding frame, obtained from the frame memory 1. As the scene change detection portion 5, for example, a detection device is used which detects whether or not the scene has changed between the preceding frame and the present frame, based upon a detection result of an action between the frames.

Upon detection of the scene change, the scene change detection portion 5 transmits this information to the signal level detection portion 3. The signal level detection portion 3 updates the signal level detection result ("Class", "GAIN" and "VTH") only when the scene change has been detected and outputs it. When the scene change has not been detected, the signal level detection portion 3 continues to output the previous signal level detection result ("Class", "GAIN" and "VTH".

In Example 3, it is possible to prevent flicker from occurring due to variations in luminance level in each frame.

[D] EXAMPLE 4

Next, an example in the case of applying the present invention to an active display is described.

[1] Description of Active Display.

Figure 17:
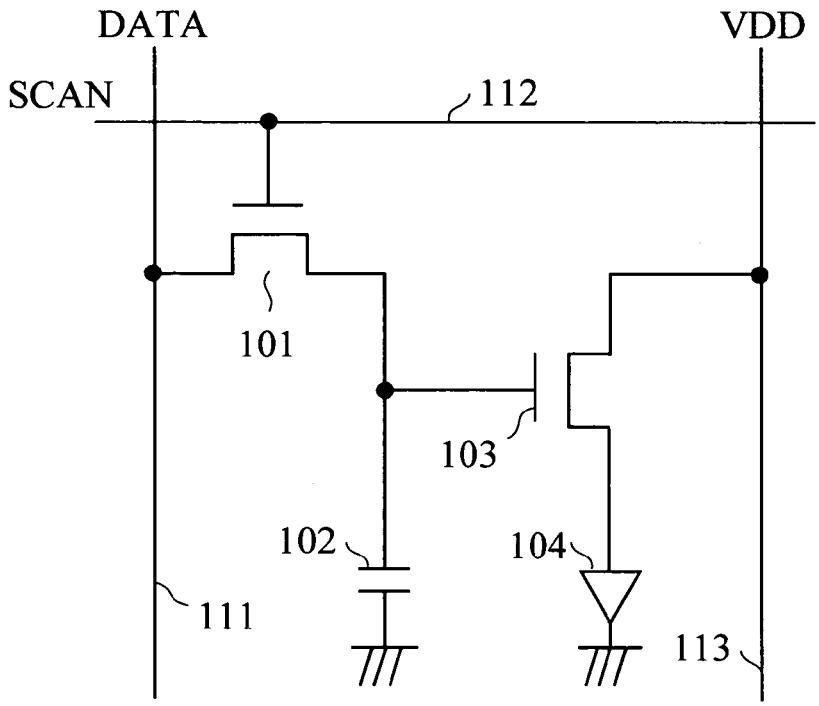
FIG. 17 is a view of an electric circuit showing a basic pixel configuration of an active display.

FIG. 17 shows a basic pixel configuration of an active display.

A circuit for one pixel of an active display (self light-emitting display) is constituted of a switch TFT 101, a capacitor 102, a drive TFT 103, and an inorganic EL element (light-emitting device) 104.

A display signal "Data" is applied to a drain of the switch TFT 101 through a data line 111. A selection signal "SCAN" is applied to the gate of the switch TFT 101 through a scanning line 112. The source of the switch TFT 101 is connected with the gate of the drive TFT 103, and also grounded through the capacitor 102. A driving power-supply voltage "VDD" is applied to the drain of the drive TFT 103 through a power-supply line 113. The source of the drive TFT 103 is connected with the anode of the inorganic EL element 104. The cathode of the inorganic EL element 104 is grounded.

The switch TFT 101 is on/off-controlled by the selection signal "SCAN". The capacitor 102 is charged by the display signal "Data" supplied through the switch TFT 101 when the switch TFT 101 is ON. The charging voltage is maintained when the switch TFT 101 is OFF. The drive TFT 103 provides the inorganic EL element 104 with a current according to a holding voltage of the capacitor 102 to be added to the gate.

Figure 18:
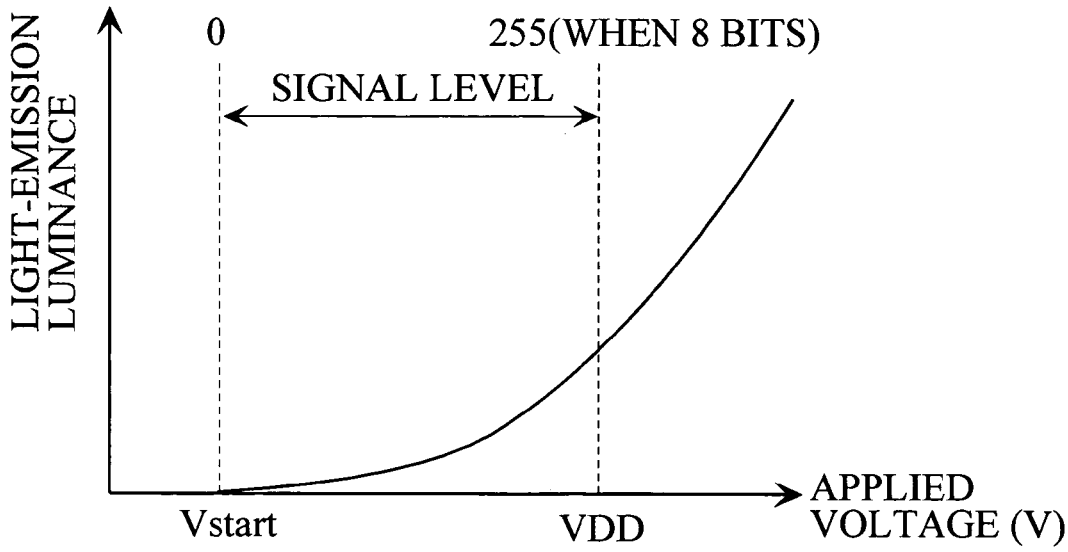
FIG. 18 is a graph showing a light-irradiating characteristic of a self light-emitting element for use in the active display (self light-emitting display).

FIG. 18 shows a light-irradiating characteristic of a self light-emitting element for use in the active display (self light-emitting display).

As shown in FIG. 18, the self light-emitting element starts emitting light upon application of an applied voltage "Data" which is not lower than the light-emission starting voltage "Vstart". The light-emission luminance increases as the applied voltage "Data" to the self light-emitting element becomes higher. However, when the signal level is the maximum value (255), the applied voltage to the light-emitting element becomes equivalent to the drive power-supply voltage "VDD".

[2] Description of Concept of the Present Invention

It is assumed that, when a signal level is expressed by eight bits, the minimum value of the signal level in one screen is 128 and the maximum value thereof is 255.

Figure 19:
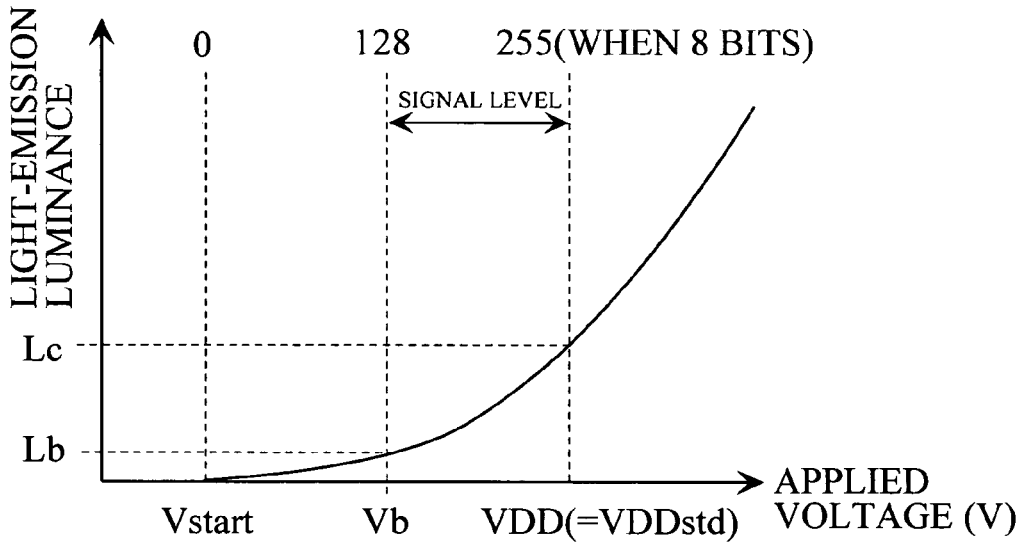
FIG. 19 is a graph showing an example of the conventional control.

FIG. 19 shows an example of the control in a conventional example. In the conventional example, the driving power-supply voltage "VDD" is set to "VDDstd". As shown in FIG. 19, in the frame, the applied voltage to the light-emitting element is "Vb" when the signal level is the minimum value (128) of the frame, whereas the applied voltage the light-emitting element is "VDD" when the signal level is the maximum value (255) of the frame. Accordingly, the range of the light-emission luminance is the luminance range of "Lb" to "Le", which corresponds to the range of the applied voltage of "Vb" to "VDD".

Figure 20:
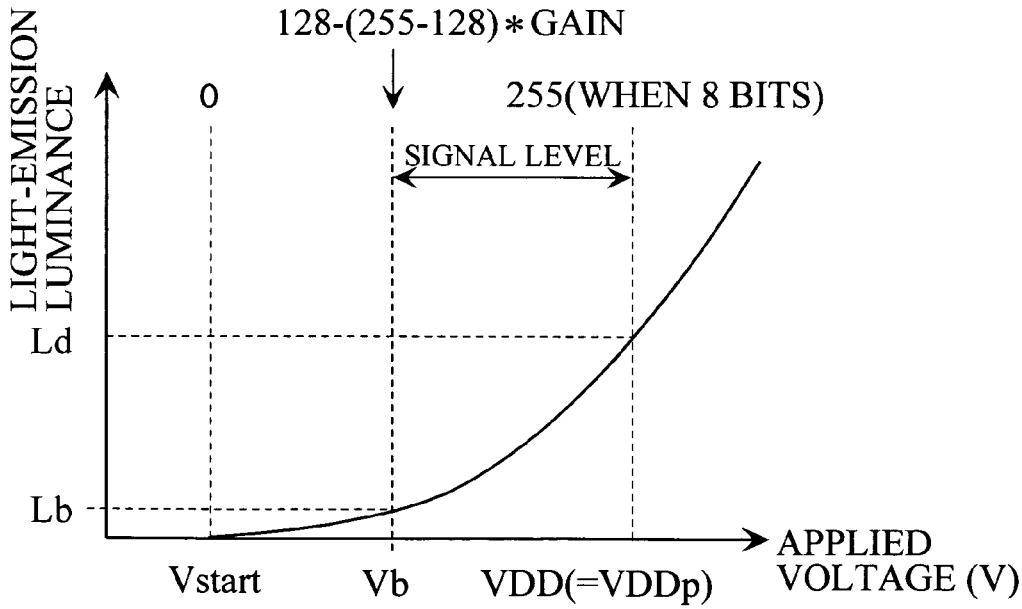
FIG. 20 is a graph showing a concept of the present invention.

In the present invention, as shown in FIG. 20, the driving power-supply voltage "VDD" is set to "VDDp" which is a higher value than "VDDstd". The signal level "S" is then corrected to "S−(255−S)×GAIN". As a result, when the signal level in this frame is the maximum value (255) of the frame, the applied voltage to the light-emitting element is "VDDp". Further, when the signal level in this frame is the minimum value (128) of the frame, the applied voltage to the light-emitting element is "Vb", for example. Accordingly, the range of the light-emission luminance is the luminance range of "Lb" to "Ld", which corresponds to the range of the applied voltage of "Vb" to "VDDp", thereby improving the luminance level.

[3] Description of Configuration of Display Device

Figure 21:
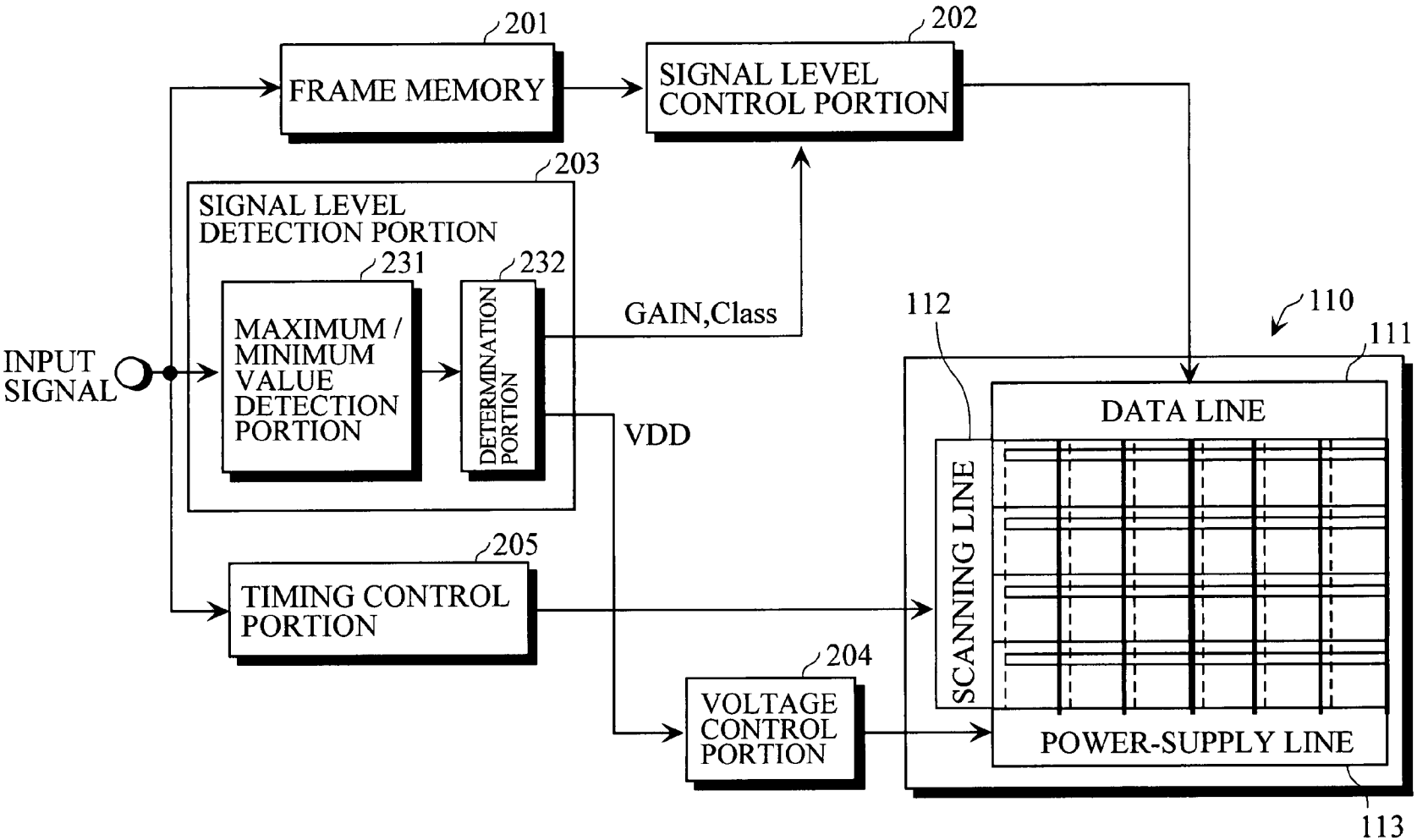
FIG. 21 is a block diagram showing an electric configuration of a display device comprising a self light-emitting display such as an inorganic EL display.

FIG. 21 shows an electric configuration of a display device comprising a self light-emitting display such as an inorganic EL display.

An input signal (8-bit digital signal) is sent to a frame memory 201, a signal level detection portion (signal level range determination means) 203, and a timing control portion 205. The input signal stored in the frame memory 201 is sent to a data line 111 of a self light-emitting display 110 after the signal level has been corrected by a signal level control portion (input signal correction means) 202. A scanning line 112 of the self light-emitting display 110 is controlled by the timing control portion 205. The power-supply line 113 of the self light-emitting display 110 is controlled by a voltage control portion (driving power-supply voltage control means) 204. The signal level detection portion 203 gives a control signal to the signal level control portion 202 and also gives a control signal to the voltage control portion 204.

[3-1] Description of Signal Level Detection Portion 3

The signal level detection portion 203 comprises a maximum/minimum value detection portion 231 and a determination portion 232. The maximum/minimum value detection portion 231 extracts the maximum value "MAX" and the minimum value "MIN" of an input signal for every one frame (or every several frames), and then gives the extracted values to the determination portion 232.

Based upon the maximum value "MAX" and the minimum value "MIN" given by the maximum/minimum value detection portion 231, the determination portion 232 produces a gain "GAIN" and a classification determination signal "Class", to be given to the signal level control portion 202, and a set value "VDD" for controlling a voltage to be given to the voltage control portion 204. The gain "GAIN" is a coefficient for correcting an input signal. The classification determination signal "Class" is a determination signal for indicating a classification determined based upon the maximum value "MAX" and the minimum value "MIN". The set value "VDD" is a set value for determining a driving power-supply voltage.

The action of the determination portion 232 is described. As shown in FIG. 8, based upon the signal maximum value "MAX", the signal minimum value "MIN", and previously set standard values: minA, maxA, minC and maxC in one frame, the determination portion 232 first determines to which of four classifications: A, B, C and D, a range where the signal maximum value "MAX" and the signal minimum value "MIN" are present belongs.

As shown in FIG. 8, each of the standard values: minA, maxA, minC and maxC, has been set such that the relationship: $0=minA<minC<maxA<maxC=255$, is maintained in the range (0 to 255) where an input signal can be present.

When the signal maximum value "MAX" and the signal minimum value "MIN" in one frame are present in a range not smaller than "minC" and not larger than "maxA", the classification of this range is determined to be "B". The classification B represents the case where the range of the signal level in one frame is in the intermediate part of the entire level range.

When the signal maximum value "MAX" and the signal minimum value "MIN" in one frame are present in a range not smaller than "minA" and not larger than "maxA", and the classification B does not apply, the classification of the range is determined to be "A". The classification A represents the case where the range of the signal level in one frame is the entire level range except for a high luminance part.

When the signal maximum value "MAX" and the signal minimum value "MIN" one frame are present in a range not smaller than "minC" and not larger than "maxC", and the classification B does not apply, the classification of the range is determined to be "C". The classification C represents the case where the range of the signal level in one frame is the entire level range except for a low luminance part.

When none of the classifications A, B and C applies, the classification of the range is determined to be "D". The classification D represents the case where the range of the signal level in one frame is a broad range from the low luminance part through the high luminance part.

Next, based upon the classification results, the determination portion 232 determines a classification determination signal "Class", a gain "GAIN", and a set value "VDD" as follows:

When the classification result is "B":
Class=2, GAIN=Gb, VDD=VDDb

When the classification result is "A":
Class=0, GAIN=Ga, VDD=VDDa

When the classification result is "C":
Class=1, GAIN=Gc, VDD=VDDc

When the classification result is "D":
Class=0, GAIN=0, VTH=VDDd

Herein, the scales of the set values are expressed by: VDDa (=VDDd)<VDDb<VDDc. It is to be noted that "Ga", "Gb" and "Gc" are set to values in a range not smaller than 0 and not larger than 1.

[3-2] Description of Signal Level Control Portion 202

The action of the signal level control portion 202 is described. The signal level control portion 202 corrects a level of an input signal "S" based upon the classification determination signal "Class" and the gain "GAIN", given by the signal level detection portion 203, using the following formula (3). Herein, "SS" represents a signal after the correction (an output signal of the signal level control portion 202).

When Class=0 (the classification is "A" or "D")

$$SS=S+S*\mathrm{GAIN}$$

When Class=1 (the classification is "C")

$$SS=S-(255-S)*\mathrm{GAIN}$$

When Class=2 (the classification is "B")

$$SS=S-(\mathrm{MAX}-S)*\mathrm{GAIN} \quad (3)$$

When Class=1, the correction formula in the case of Class=2 may be used. Although "GAIN" is set by classification in the above example, "GAIN" may be set more adaptively according to the maximum value and the minimum value in one screen. It should be noted that, although the signal level control portion 202 produces the output signal "SS" based upon the above formula (3), tables representing a relation between the input signal "S" and the output signal "SS" in the respective cases of Class=0, Class=1 and Class=2 may be previously prepared, and based upon these tables, the input signal "S" may be corrected.

[3-3] Description of Voltage Control Portion 204

The action of the voltage control portion 204 is described. The voltage control portion 204 controls a driving power-supply voltage, based upon the set value "VDD" given by the signal level detection portion 203. That is, when the classification result is "B", "VDD" is equivalent to "VDDb", and thus the driving power-supply voltage "VDD" to be supplied to the power-supply line 113 is controlled so as to become equivalent to "VDDb". When the classification result is "A", "VDD" is equivalent to "VDDa", and thus the driving power-supply voltage "VDD" to be supplied to the power-supply line 113 is controlled so as to become equivalent to "VDDa". When the classification result is "C", "VDD" is equivalent to "VDDc", and thus the driving power-supply voltage "VDD" to be supplied to the power-supply line 113 is controlled so as to become equivalent to "VDDc". When the classification result is "D", "VDD" is equivalent to "VDDd", and thus the driving power-supply voltage "VDD" to be supplied to the power-supply line 113 is controlled so as to become equivalent to "VDDd".

[4] Description of Control Results

Figure 22A:
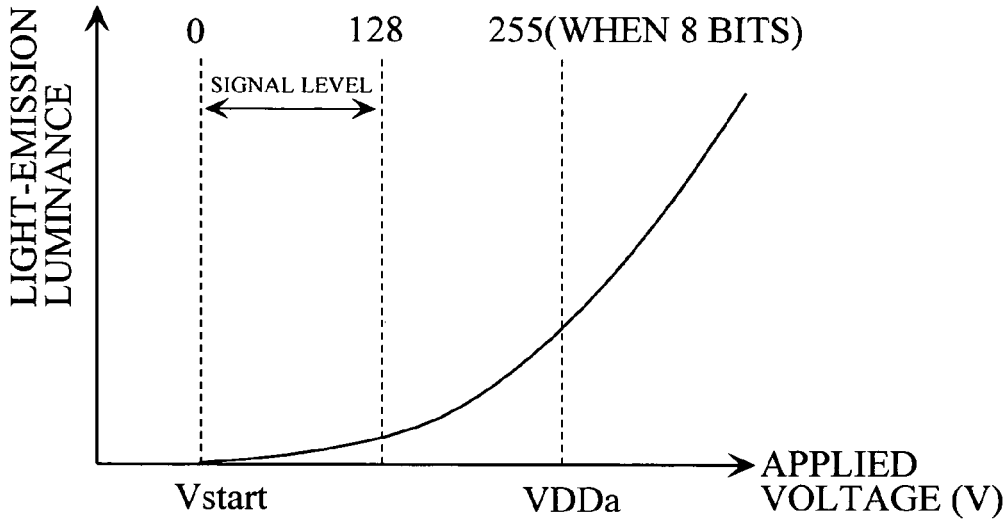
FIGS. 22*a* and 22*b* show results of controls when the classification result is "A".
Figure 22B:
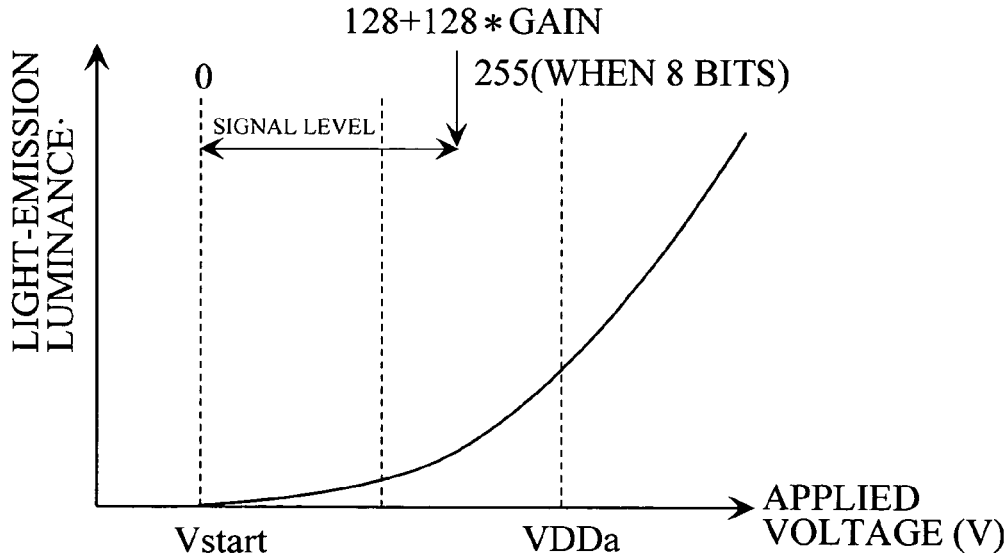

The result of the control of (MIN=0, MAX=128) when the classification result is "A" is described. FIG. 22*a* shows the result of the control in the conventional example described using FIG. 19. FIG. 22*b* shows the result of the control in the example of the present invention (hereinafter referred to as the present method).

Both in the conventional Example and the present method, the driving power-supply voltage "VDD" is set to "VDDa (=VDDstd). In the conventional example, the input signal level is not corrected, whereas in the present method, the input signal "S" is corrected based upon the formula: SS=S+S*GAIN, and the range of the input signal level is thus extended to the high luminance side. It is thereby possible in the present method to make the luminance higher than that of the conventional example.

Figure 23A:
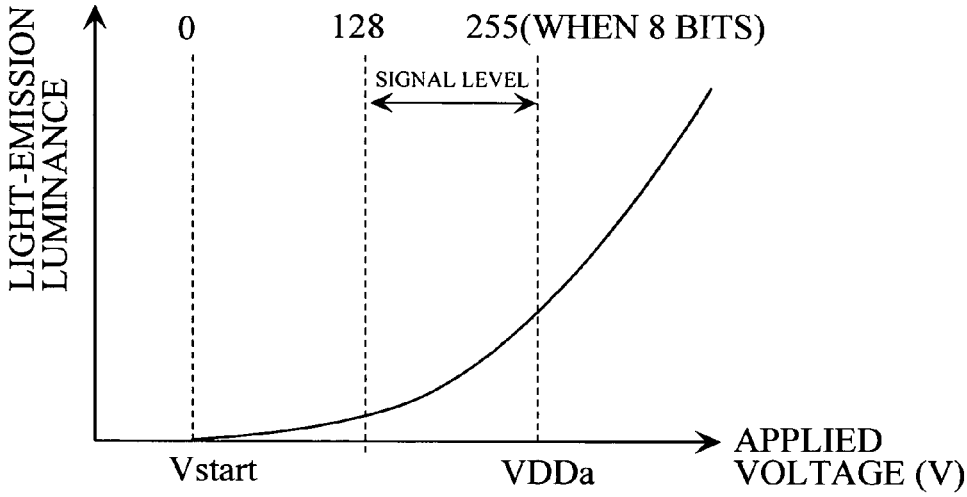
FIGS. 23*a* and 23*b* show results of controls when the classification result is "C".
Figure 23B:
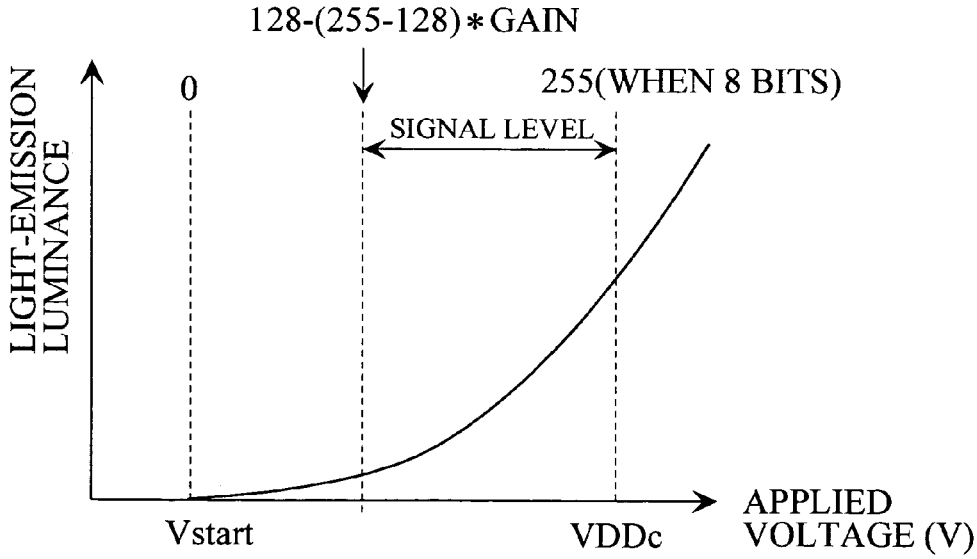

The result of the control of MIN=128, MAX=255) when the classification result is "C" is described. FIG. 23*a* shows the result of the control in the conventional example described using FIG. 19. FIG. 23*b* shows the result of the control in the example of the present invention (hereinafter referred to as the present method).

In the conventional example, the driving power-supply voltage "VDD" is set to "VDDa(=VDDstd), whereas in the present method, the driving power-supply voltage "VDD" is set to "VDDc" (>VDDa). Further, in the present method, since the input signal "S" is corrected based upon the formula: SS=S−(255−S)*GAIN, the range of the input signal level is extended to the low luminance side. It is thereby possible in the present method to increase the light-emission luminance on the high luminance side.

Figure 24A:
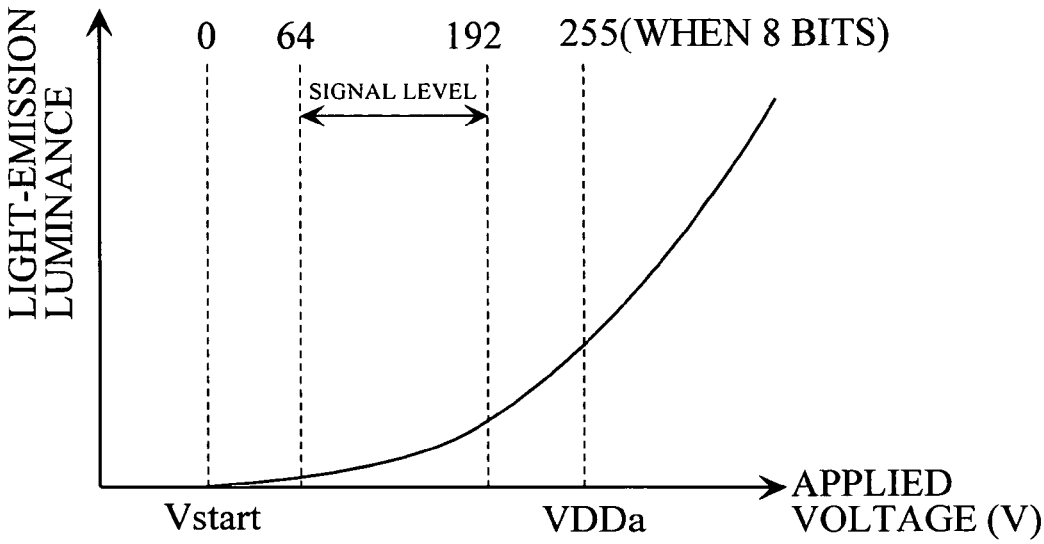
FIGS. 24*a* and 24*b* show results of controls when the classification result is "B".
Figure 24B:
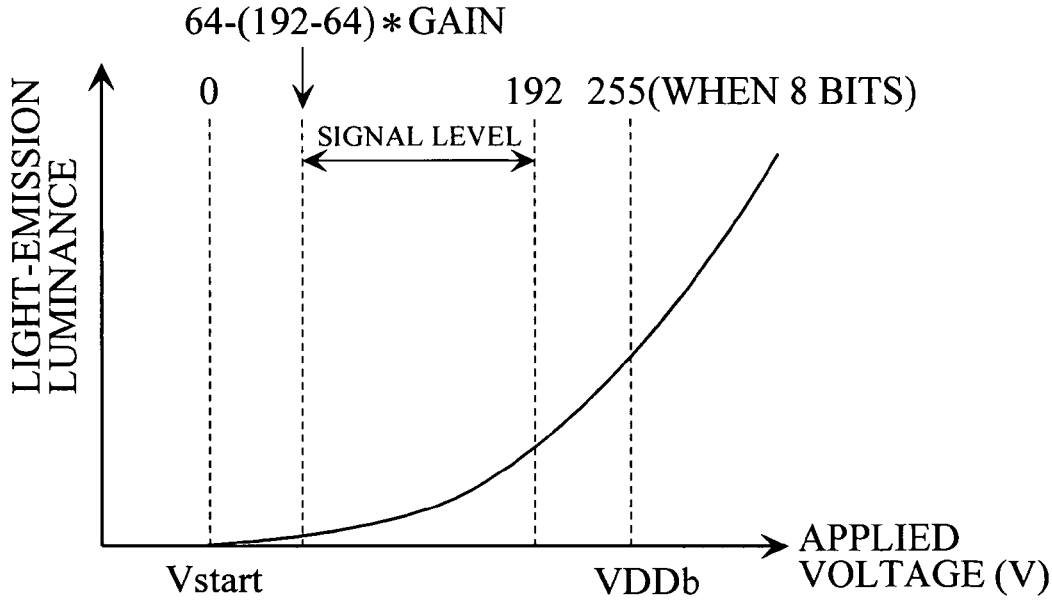

The result of the control of (MIN=64, MAX=192) when the classification result is "B" is described. FIG. 24*a* shows the result of the control in the conventional example described using FIG. 19. FIG. 24*b* shows the result of the control in the example of the present invention (hereinafter referred to as the present method).

In the conventional example, the driving power-supply voltage "VDD" is set to "VDDa" (=VDDstd), whereas in the present method, the driving power-supply voltage "VDD" is set to "VDDb" (>VDDa). Further, in the present method, since the input signal "S" is corrected based upon the formula: SS=S−(MAX−S)*GAIN, the range of the input signal level is extended to the low luminance side. Further, in the present method, the light-emission luminance is higher on the high luminance side than in the conventional example, due to the shift of "VDD". It is thereby possible in the present method to increase the light-emission luminance on the high luminance side so as to improve contrast.

In Example 4, although the signal level detection portion 203 updates the signal level detection result ("Class", "GAIN" and "VDD") for every one frame (every several frames), the signal level detection portion 203 may be arranged to update the signal level detection result ("Class", "GAIN" and "VDD") only when a scene change is detected.

What is claimed is:

1. A display device comprising:

a maximum/minimum value detection portion for receiving an input signal, and for extracting the maximum value (MAX) and the minimum value (MIN) of an input signal for at least one frame;

a signal level detection portion which provides a classification result based on the extracted values MIN and MAX;

a signal determination portion which provides a gain, a classification, and a set value, in response to the classification result;

a signal level control portion for receiving the gain and the classification, and for outputting a modulating voltage;

a data driver for receiving the modulating voltage and driving at least one data electrode;

a threshold voltage control portion for receiving the set value, and for determining a threshold voltage; and a scanning driver for receiving the determined threshold voltage, and for driving at least one scanning electrode, wherein:

the classification result is one of: A, B, C, and D;

standard values comprise:

a minimum value minA, a maximum value maxA, a minimum value minC, and a maximum value maxC;

the standard values satisfy 0=minA<minC<maxA<maxC=maximum signal; and the signal level detection portion is configured to determine the classification result as follows:

(i) the classification result is B if minC≦(MIN and MAX)≦maxA, (ii) if the classification result is not B, then the classification result is A if minA≦(MIN and MAX)≦maxA, (iii) if the classification result is not B, then the classification result is C if minC≦(MIN and MAX)≦maxC, and (iv) if the classification result is not B, and the classification result is not A, and the classification result is not C, then the classification result is D.

2. The display device of claim 1, wherein the signal determination portion determines a classification signal (Class), a gain (GAIN), and a set value (VTH) according to the following logic:

if the classification result is B, then Class=2, GAIN=Gb, VTH=VTHB;

if the classification result is A, then Class=0, GAIN=Ga, VTH=VTHA;

if the classification result is C, then Class=1, GAIN=Gc, VTH=VTHC; and if the classification result is D, then Class=0, GAIN=0, VTH=VTHD;

wherein VTHA=VTHD<VTHB<VTHC, wherein VTHA has been set to the light emission starting voltage, and wherein Ga, Gb, and Gc are set to values larger than 0 and smaller than 1.

3. The display device of claim 2, wherein the signal level control portion corrects a level of an input signal (S) based upon the classification signal (Class) and the Gain (GAIN) according to the following logic to produce a corrected signal (SS):

if Class=0, then SS=S+S*GAIN if Class=1, then SS=S−(maximum signal−S)*GAIN, and if Class=2, then SS=S−(MAX−S)*GAIN.

4. The display device of claim 2, wherein the threshold voltage control portion controls a threshold value as a function of the determined set value (VTH).

5. The display device of claim 1, wherein the signal determination portion is configured to determine the classification signal (Class), the gain (GAIN), and the set value (VTH) periodically every predetermined number of frames, and wherein the predetermined number of frames is equal to or greater than one.

6. The display device of claim 5, wherein the signal level control portion is configured to update the signal level upon a determination that a scene has changed.

7. The display device of claim 1, wherein:

the threshold voltage VTH=the light emission starting voltage VSTART, and a corrected signal SS=S+S*GAIN.

8. The display device of claim 7, wherein wherein the signal determination portion determines a classification signal (Class), a gain (GAIN), and a set value (VTH) according to the following logic:

if the classification result is B or D, then Class=0, GAIN=0, VTH VTHB;

if the classification result is A, then Class=0, GAIN=Ga, VTH=VTHA; and if the classification result is C, then Class=1, GAIN=Gb, VTH=VTHC;

wherein VTHA=VSTART<VTHB<VTHC, and wherein Ga, and Gb are set to values larger than 0 and smaller than 1.

9. The display device of claim 8, wherein the signal level control portion corrects a level of an input signal (S) based upon the classification signal (Class) and the Gain (GAIN) according to the following logic to produce a corrected signal (SS):

if Class=0, then SS=S+S*GAIN, and if Class=1, then SS=S−(maximum signal−S)*GAIN.

* * * * *